US009026001B2

(12) United States Patent
Numata et al.

(10) Patent No.: US 9,026,001 B2
(45) Date of Patent: May 5, 2015

(54) IMAGE BEARING MEMBER UNIT AND IMAGE FORMING APPARATUS

(71) Applicant: Canon Kabushiki Kaisha, Tokyo (JP)

(72) Inventors: Tetsuya Numata, Suntou-gun (JP); Masatoshi Yamashita, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/904,313

(22) Filed: May 29, 2013

(65) Prior Publication Data

US 2013/0322922 A1 Dec. 5, 2013

(30) Foreign Application Priority Data

Jun. 20, 2012 (JP) ..... 2012-126016
Apr. 30, 2013 (JP) ..... 2013-095691

(51) Int. Cl.
*G03G 15/02* (2006.01)
*G03G 15/00* (2006.01)
*G03G 21/18* (2006.01)

(52) U.S. Cl.
CPC ..... *G03G 15/75* (2013.01); *G03G 21/1821* (2013.01); *G03G 2215/0132* (2013.01); *G03G 2221/1684* (2013.01)

(58) Field of Classification Search
CPC ..... G03G 21/1647; G03G 21/1853; G03G 15/0178
USPC ..... 399/116
See application file for complete search history.

(56) References Cited

U.S. PATENT DOCUMENTS

| | | | | |
|---|---|---|---|---|
| 7,184,690 | B2 | 2/2007 | Ueno et al. | |
| 7,315,710 | B2 | 1/2008 | Ueno et al. | |
| 2003/0169951 | A1* | 9/2003 | Nishijima et al. | 384/103 |
| 2005/0238387 | A1 | 10/2005 | Ueno et al. | |
| 2007/0110474 | A1 | 5/2007 | Ueno et al. | |
| 2011/0103835 | A1 | 5/2011 | Hayashi et al. | |
| 2011/0305480 | A1 | 12/2011 | Tanaami et al. | |
| 2013/0108316 | A1 | 5/2013 | Sato et al. | |

FOREIGN PATENT DOCUMENTS

JP 2005-338751 A 12/2005

OTHER PUBLICATIONS

Machine translation of Takahito JP 2005-338751 A, publication date: Aug. 12, 2005.*

* cited by examiner

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

An image bearing member unit includes an image bearing member having a supported portion, a supporting member for rotatably supporting the supported portion, a frame for holding the supporting member, and a spacing maintaining portion provided on the frame or the image bearing member. The spacing maintaining portion is disposed outside the supported portion in a radial direction, and is disposed inside a region where the supporting member supports the supported portion. In a state in which the supporting member is not mounted on the frame, the spacing maintaining portion maintains a spacing between the frame and the supported portion in contact with the image bearing member or the frame. In a state in which the supporting member is mounted on the frame, the supporting member is inserted into the spacing between the frame and the supported portion, from outside of the spacing maintaining portion.

22 Claims, 19 Drawing Sheets

(a)

(b)

(a)

(b)

IMAGE BEARING MEMBER UNIT AND IMAGE FORMING APPARATUS

FIELD OF THE INVENTION AND RELATED ART

The present invention relates to an image forming apparatus and an image bearing member unit for use with the image forming apparatus.

The image forming apparatus forms an image on a recording material by using, e.g., an electrophotographic process. Examples of the image forming apparatus may include an electrophotographic copying machine, an electrophotographic printer (e.g., a laser beam printer, an LED printer or the like), a facsimile machine, a word processor, and the like.

Further, the image bearing member unit is a unit (apparatus) including an image bearing member and a supporting portion for the image bearing member.

In the field of a conventional image forming apparatus, a constitution in which a process cartridge is mounted and demounted inside an apparatus main assembly of the image forming apparatus has been known. Inside such a process cartridge, a photosensitive drum supporting apparatus (image bearing member unit) for supporting a photosensitive drum (image bearing member) is provided. In this constitution, an end portion of the photosensitive drum is supported by a first supporting member (first cover) constituting a frame of the process cartridge, and another end portion of the photosensitive drum is supported by a second supporting member (second cover) constituting the frame of the process cartridge. As an invention relating to such a constitution, Japanese Laid-Open Patent Application (JP-A) 2005-338751 discloses the following invention.

FIG. 15 is an exploded perspective view showing a constitution of a photosensitive drum supporting apparatus 93 corresponding to the constitution of JP-A 2005-338751. A photosensitive drum 4 includes a first flange 51 (driving-side drum flange) as a first member-to-be-supported at an end portion thereof with respect to a rotational axis direction M, and includes a second flange 52 (non-driving-side drum flange) as a second member-to-be-supported at another end portion thereof with respect to the rotational axis direction M. The first flange 51 and the second flange 52 which are engaged with the photosensitive drum 4, a first shaft (axis) portion 51*b* and a second shaft portion 52*b* are provided, respectively. The first shaft portion 51*b* and the second shaft portion 52*b* are rotatably supported by a first supporting portion 24*a* and a second supporting portion 25*a*, respectively, which are provided on a first cover 24 and a second cover 25, respectively.

Further, a frame 26 supported by the first cover 24 and the second cover 25 is provided, and the frame 26 includes frame supporting portions 26*a* corresponding to one and another end portions of the photosensitive drum 4 with respect to the rotational axis direction M. These frame supporting portions 26*a* are engaged with a first groove 24*b* and a second groove 25*b* provided on outer peripheral surfaces of the first supporting portion 24*a* of the first cover 24 and the second supporting portion 25*a* of the second cover 25, so that the frame 26 is supported by the first cover 24 and the second cover 25. By employing the above-described constitution, it becomes possible to position the photosensitive drum 4 with high accuracy.

Parts (a) and (b) of FIG. 16 are exploded perspective views of the photosensitive drum supporting apparatus. FIG. 17 is an exploded perspective view showing a state in which the photosensitive drum 4 is temporarily placed on the frame 26.

FIG. 18 is a side view of the photosensitive drum 4 and the frame 26 as seen from an arrow J3 direction indicated in FIG. 17. FIG. 19 is a sectional view showing a state immediately before the first cover 24 is assembled with the frame 26. While referring to these FIGS. 16-19, an assembling method of the photosensitive drum supporting apparatus 93 will be described below. Here, a driving-side drum flange side is referred to as a driving side, a non-driving-side drum flange side is referred to as a non-driving side. When the rotational axis direction M of the photosensitive drum 4 is a longitudinal direction, portions in the driving side and the non-driving side provide a symmetrical shape with respect to a longitudinal central portion of the photosensitive drum 4. For that reason, the portions in the driving side and the non-driving side have the same constitution, and in the following, the constitution of the portion in the driving side will be specifically described.

As shown in FIG. 16, the photosensitive drum 4 is moved in an arrow H3 direction, and is assembled with a frame arcuate portion 26*b* formed at a frame supporting portion 26*a* of the frame 26. Then, as shown in FIG. 17, the photosensitive drum 4 is temporarily placed on the frame 26. In a state in which the photosensitive drum 4 is temporarily placed on the frame 26 as shown in FIGS. 17 and 18, the photosensitive drum 4 is not positionally aligned with a specific portion. For that reason, as shown in FIG. 18, in a state an arrow K3 direction is directed downward, the photosensitive drum 4 is temporarily placed on the frame 26, so that the photosensitive drum 4 is prevented from being detached and dropped from the frame 26. As a result, by a self-weight of the photosensitive drum 4, the first shaft portion 51*b* of the first flange 51 is contacted to the frame arcuate portion 26*b* of the first frame supporting portion 26*a*.

In order to slidably move the first shaft portion 51*b* of the first flange 51 and the first supporting portion 24*a* of the first cover 24, for the purpose of reducing a torque and preventing abrasion (wearing), as shown in FIGS. 17 and 18, a lubricant 90 is applied onto an outer peripheral surface, as a sliding movement surface, of the first shaft portion 51*b*. The lubricant 90 is applied onto the outer peripheral surface of the first shaft portion 51*b* where the first shaft portion 51*b* is not contacted to the first frame arcuate portion 26*b*. However, the photosensitive drum 4 is in the temporarily placed state, and therefore is rotatable in an arrow L3 direction and an arrow M3 direction in FIG. 18. For that reason, when the photosensitive drum 4 rotates, the lubricant 90 applied onto the first shaft portion 51*b* is adhered to the first frame arcuate portion 26*b*.

In order to prevent an occurrence of this phenomenon, there is a need to fix, until the first cover 24 is assembled with the frame 26, the photosensitive drum 4 so as not to be rotated in the state in which the photosensitive drum 4 is temporarily placed on the frame 26. By employing such an assembling method, it is possible to supply a necessary amount of the lubricant 90 to the first shaft portion 51*b* (sliding movement portion) of the first flange 51 and the first supporting portion 24*a* of the first cover 24.

Incidentally, also when the photosensitive drum 4 is moved in its longitudinal direction, the lubricant 90 applied onto the first shaft portion 51*b* adheres to an unnecessary place. However, as shown in FIGS. 16, 18 and 19, when the photosensitive drum 4 is moved in the longitudinal direction, a flange end surface 51*c* of the first flange 51 is contacted to an inside end surface 26*e* of the first frame supporting portion 26*a* provided inside the frame supporting portion 26*a* with respect to the longitudinal direction. Therefore, the photosensitive drum 4 is not moved in the longitudinal direction in a distance equal to or larger than a clearance c between the flange end surface 51*c* and the inside end surface 26*e* of the first frame supporting portion 26*a* as shown in FIG. 19. The longitudinal clearance c is very small, so that the lubricant 90 applied onto the shaft portion 51*b* does not adhere to the unnecessary place by the movement of the photosensitive drum 4 in the longitudinal direction.

However, in the invention described in JP-A 2005-338751, there was the following problem. That is, in some cases, when the photosensitive drum (image bearing member) 4 is temporarily placed on the frame 26, the photosensitive drum 4 rotates in a circumferential direction. When the photosensitive drum 4 rotates, the lubricant 90 applied onto the shaft portion 51*b* of the first flange 51 (non-driving-side drum flange) adheres to the frame arcuate portion 26*b* of the frame 26. As a result, the lubricant 90 in a necessary amount cannot be supplied to the first shaft portion 51*b* having the sliding movement surface. In order to prevent this phenomenon, there is a need to employ an assembling method such that rotation of the photosensitive drum 4 is controlled so that the shaft portion 51*b* on which the lubricant 90 is applied does not rotate in the circumferential direction until the first cover 24 (non-driving-side cover member) is assembled with the frame 26.

Further, as shown in FIG. 19, the lubricant 90 adheres to the frame arcuate portion 26*b* of the frame 26, and therefore when the first cover 24 (non-driving-side cover member) is assembled with the frame 26 from an arrow J3 direction in FIG. 19, the lubricant 90 is pushed into an arrow P3 direction in FIG. 19. As a result, the lubricant 90 adheres to the surface of the photosensitive drum 4 to cause image defect.

SUMMARY OF THE INVENTION

In view of the above-described problem, a principal object of the present invention is to provide an image bearing member unit capable of supplying a lubricant in a necessary amount to a supported portion of an image bearing member by a simple assembling method to suppress adhesion of the lubricant to a place other than the supported portion.

Another object of the present invention is to provide an image forming apparatus including the image bearing member unit.

According to an aspect of the present invention, there is provided an image bearing member unit for use with an image forming apparatus, comprising: an image bearing member including a supported portion onto which a lubricant is applied; a supporting member for rotatably supporting the supported portion of the image bearing member; a frame for holding the supporting member; and a spacing maintaining portion provided on the frame or the image bearing member, wherein the spacing maintaining portion is disposed outside the supported portion with respect to a radial direction of the image bearing member, and is disposed inside, with respect to a longitudinal direction of the image bearing member, a region where the supporting member supports the supported portion, and wherein when the supporting member is not mounted on the frame, the spacing maintaining portion maintains a spacing between the frame and the supported portion in contact with the image bearing member or the frame.

According to another aspect of the present invention, there is provided an image bearing member unit for use with an image forming apparatus, comprising: an image bearing member including a supported portion onto which a lubricant is applied; a supporting member for rotatably supporting the supported portion of the image bearing member; a frame for holding the supporting member; and a spacing maintaining portion provided on the frame or the image bearing member, wherein in a state in which the supporting member is not mounted on the frame, the spacing maintaining portion maintains a spacing between the supported portion and the frame in contact with the image bearing member or the frame, and wherein in a state in which the supporting member is mounted on the frame, the spacing maintaining portion is spaced from the image bearing member or the frame.

According to a further aspect of the present invention, there is provided an image forming apparatus for forming an image on a recording material, comprising: an image bearing member unit, wherein the image bearing member unit comprises: an image bearing member including a supported portion onto which a lubricant is applied; a supporting member for rotatably supporting the supported portion of the image bearing member; a frame for holding the supporting member; and a spacing maintaining portion provided on the frame or the image bearing member, wherein the spacing maintaining portion is disposed outside the supported portion with respect to a radial direction of the image bearing member, and is disposed inside, with respect to a longitudinal direction of the image bearing member, a region where the supporting member supports the supported portion, and wherein when the supporting member is not mounted on the frame, the spacing maintaining portion maintains a spacing between the frame and the supported portion in contact with the image bearing member or the frame.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Parts (a) and (b) of FIG. 1 are exploded perspective views of FIG. 9.

Figure 16:
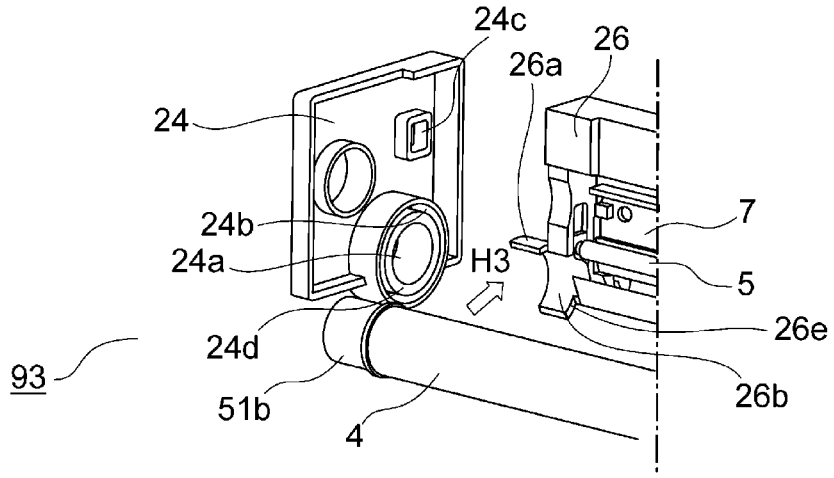
Figure 16:
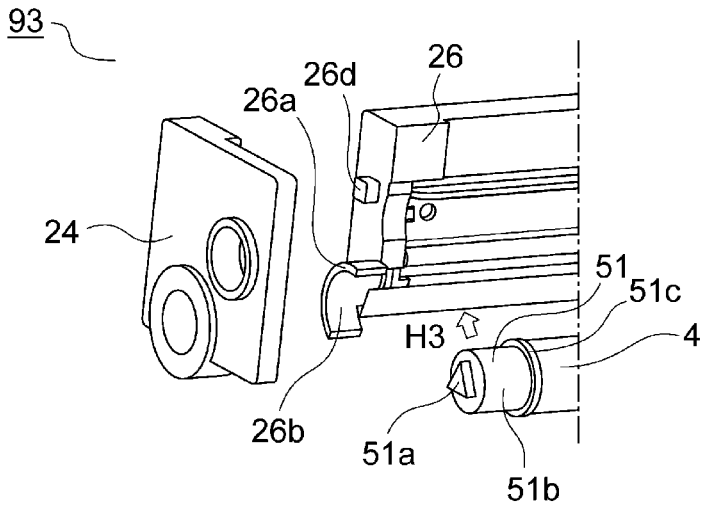

Parts (a) and (b) of FIG. 16 are exploded perspective views of the photosensitive drum supporting apparatus.

Figure 17:
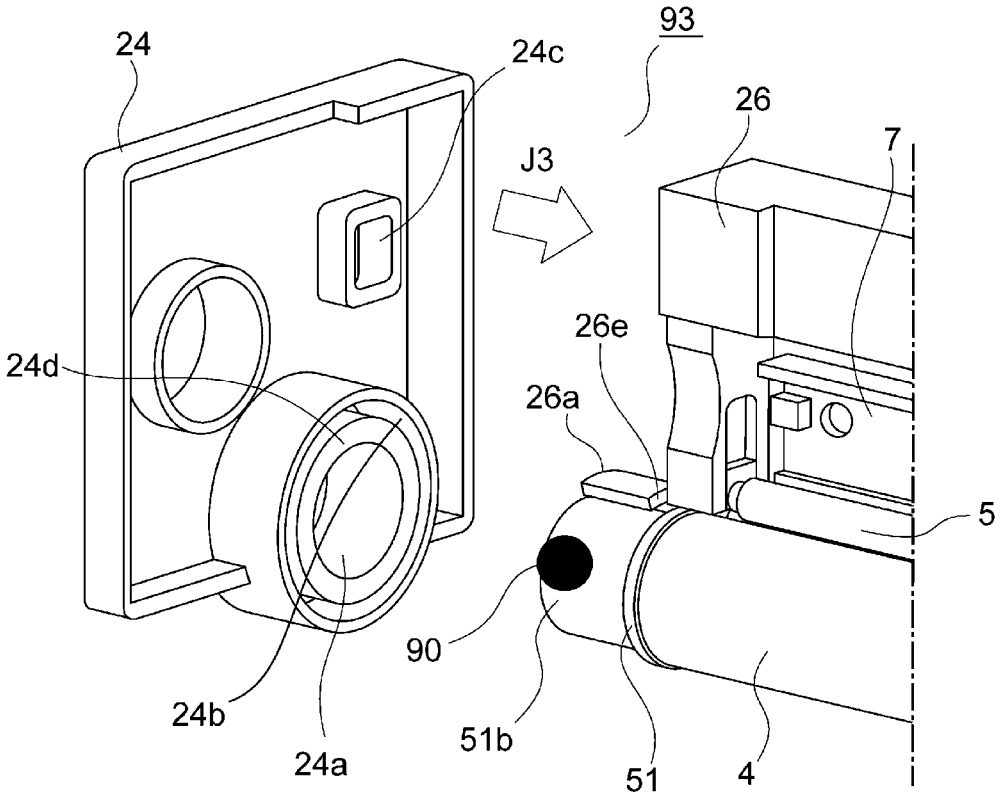

FIG. 17 is an exploded perspective view showing a state in which a photosensitive drum is temporarily placed on a frame.

Figure 18:
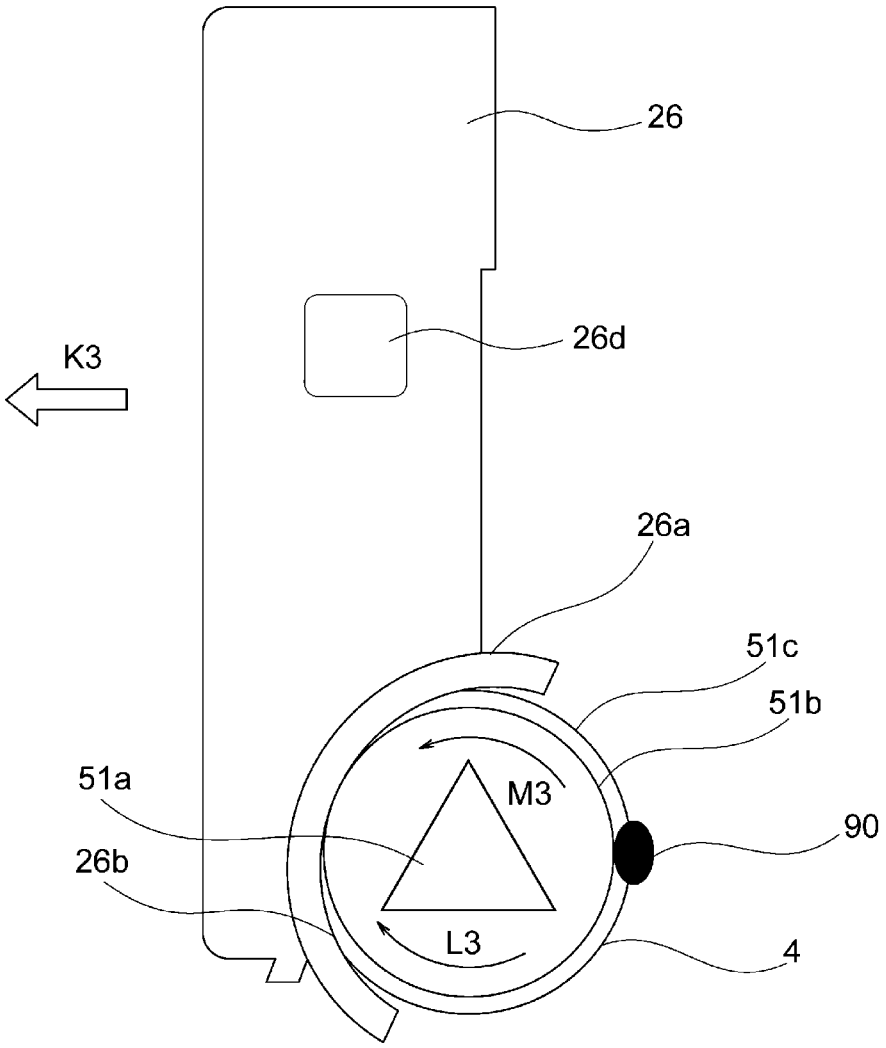

FIG. 18 is a side view as seen from an arrow J3 direction in FIG. 17.

Figure 19:
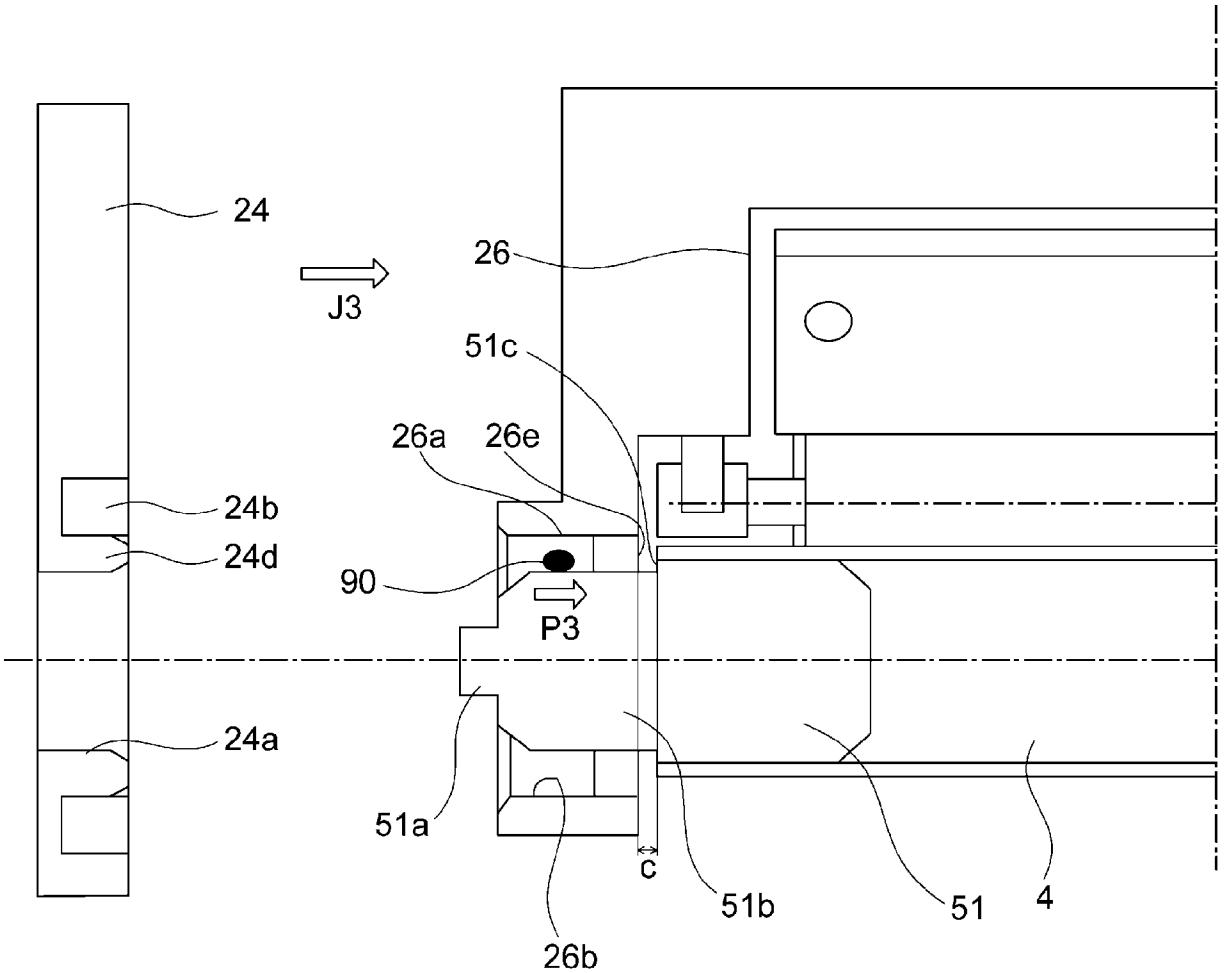

FIG. 19 is a sectional view showing a state immediately before a first cover is assembled with the frame from a state of FIG. 17.

DESCRIPTION OF THE PREFERRED EMBODIMENTS

With reference to the drawings, embodiments for carrying out the present invention will be described. However, dimensions, materials, shapes and relative positions of constituent elements described in the following embodiments should be appropriately modified depending on constitutions and various conditions of a unit or an apparatus to which the present invention is applied, and therefore, the scope of the present invention is not limited to the following embodiments, unless otherwise specified.

Embodiment 1

Figure 2:
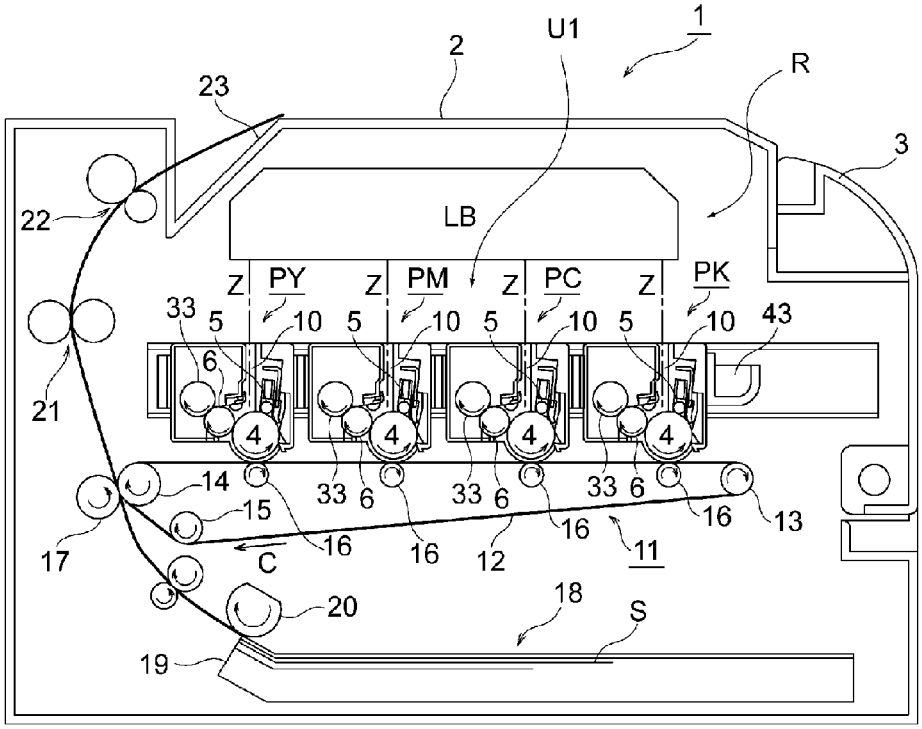
FIG. 2 is a sectional view showing a structure of an image forming apparatus including a drum supporting apparatus in Embodiment 1 of the present invention.

FIG. 2 is a sectional view showing a structure of an image forming apparatus 1 including a drum supporting apparatus 91 (FIG. 8) in Embodiment 1. The image forming apparatus 1 uses an electrophotographic image forming process. As shown in FIG. 2, the image forming apparatus 1 includes an image forming apparatus main assembly 2, and inside the apparatus main assembly 2, an image forming portion R for forming an image is provided. The image forming portion R includes photosensitive drums 4 as an image bearing member, primary transfer rollers 16 as a transfer roller for forming a nip in combination with an associated photosensitive drum 4, and the like members.

In the following embodiments, as the electrophotographic image forming apparatus, a full-color electrophotographic image forming apparatus including four cartridges P, as a process cartridge, detachably mountable to the apparatus main assembly 2 while including a drum supporting apparatus 91 is described as an example. Each process cartridge P is prepared by integrally assembling at least one of a charging means, a developing means and a cleaning means, as process means, with the photosensitive drum as the image bearing member into a unit (cartridge), and is detachably mountable to the image forming apparatus (apparatus main assembly).

However, the number of the cartridge P to be mounted in the image forming apparatus 1 is not limited to four but may appropriately be set as desired.

For example, in the case of an image forming apparatus 1 for forming a monochromatic image, the number of the cartridges P to be mounted in the image forming apparatus 1 is one. Further, in the following embodiments, as an example of the image forming apparatus, a printer is exemplified.

However, the image forming apparatus is not limited to the printer. The present invention is also applicable to, e.g., other image forming apparatuses such as a copying machine, a facsimile machine and a multi-function machine having functions of these machines in combination.

The image forming apparatus 1 is a four color-based full-color laser printer using the electrophotographic image forming process and effects color image formation on a recording material S. The image forming apparatus 1 is of a process cartridge type in which the process cartridge is detachably mountable to the apparatus main assembly 2 and a color image is formed on the recording material S.

Here, with respect to the image forming apparatus 1, the side (surface) on which an openable door 3 is provided is referred to as a front side (surface), and a side (surface) opposite to the front side (surface) is referred to as a rear side (surface). Further, a right side when the image forming apparatus 1 is viewed from the front surface is referred to as a driving side, and a left side is referred to as a non-driving side.

In the apparatus main assembly 2, four cartridges P consisting of a first cartridge PY, a second cartridge PM, a third cartridge PC and a fourth cartridge PK are provided and arranged in a horizontal direction. The respective first to fourth cartridges (PY to PK) have the same electrophotographic process mechanism but contain developers (toners) different in color from one another. To the first to fourth cartridges P (PY to PK), a rotational driving force is transmitted from a drive output portion (not shown) of the apparatus main assembly 2. Further, to the first to fourth cartridges P (PY to PK), bias voltages (charging bias, developing bias and the like) are supplied from the apparatus main assembly 2 (not shown).

Figure 3:
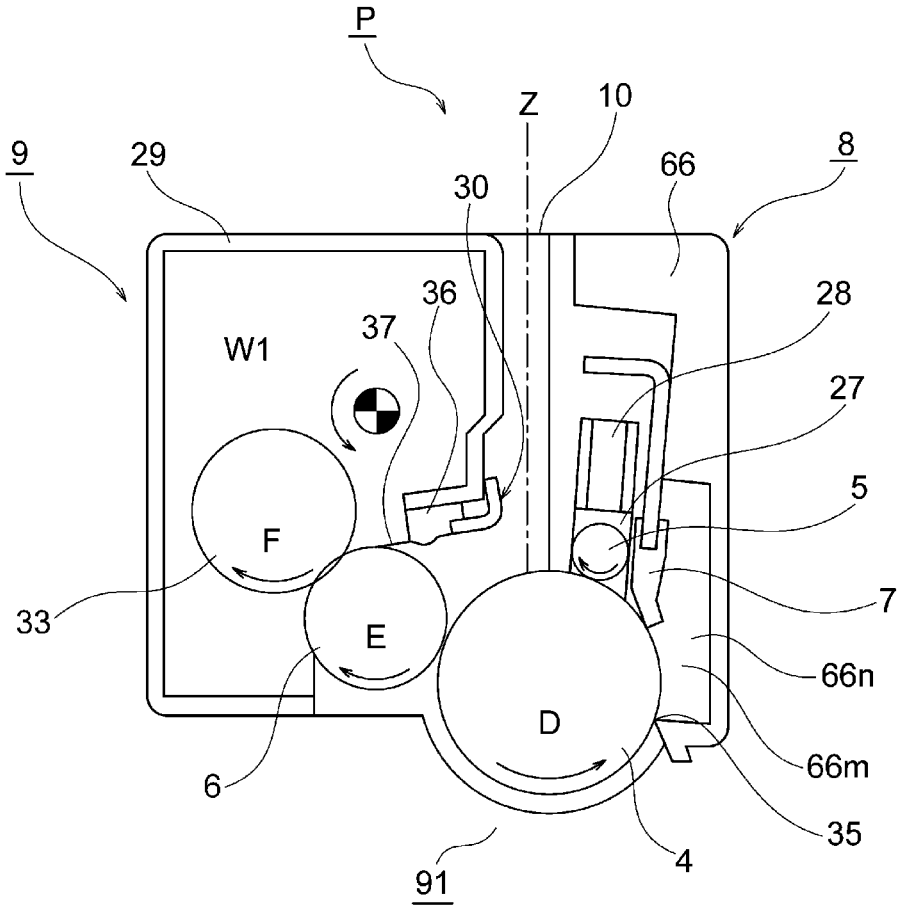
FIG. 3 is a sectional view showing a structure of a cartridge.
Figure 4:
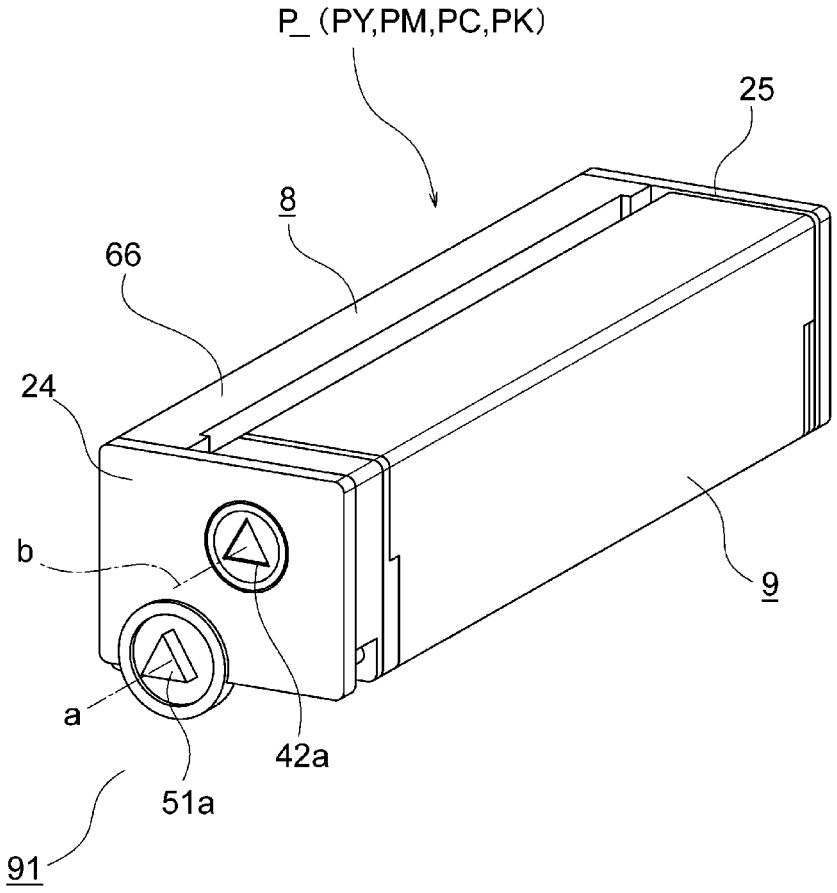
FIG. 4 is a perspective view showing a structure of the cartridge.

Each of the first to fourth cartridges P (PY to PK) includes a cleaning unit 8 and a developing unit 8 which are specifically described later (FIG. 4). The cleaning unit 8 includes the photosensitive drum 4 and the charging means and the cleaning means which are used as the process means acting on the photosensitive drum 4. The developing unit 8 includes the developing means for developing an electrostatic image on the photosensitive drum 4. The cleaning unit (cleaning device) and the developing unit 9 (developing device) are connected with each other. As the charging means, a charging roller 5 is used. As the cleaning means, a cleaning blade 7 (FIG. 3) is used. As the developing means, a developing roller 6 used as a developer carrying member is used. A more specific constitution of the cartridges will be described below.

The first process cartridge PY accommodates the toner of yellow (Y) in its developing device frame 29 (FIG. 3) and forms the toner image of yellow on the surface of the photosensitive drum 4. The second process cartridge PM accommodates the toner of magenta (M) in its frame 29 (FIG. 3) and forms the image of magenta on the surface of the photosensitive drum 4. The process third cartridge PC accommodates the toner of cyan (C) in its frame 29 (FIG. 3) and forms the toner image of cyan on the surface of the photosensitive drum 4. The fourth process cartridge PK accommodates the toner of black (K) in its frame 29 (FIG. 3) and forms the toner image of black on the surface of the photosensitive drum 4.

Here, the inside structure of the image forming apparatus 1 will be further described. Above the first to fourth process cartridges P (PY, PM, PC, PK), a laser scanner unit LB as an exposure means is disposed. This scanner unit LB outputs laser light Z correspondingly to image information. Then, the laser light Z passes through an exposure window portion 10 of each cartridge P, so that the surface of the photosensitive drum 4 is subjected to scanning exposure to the laser light L.

Under the first to fourth cartridges P (PY, PM, PC, PK), an intermediary transfer belt unit 11 as a transfer member is provided. This belt unit 11 includes a driving roller 13, a turn roller 14 and a tension roller 15, and includes a transfer belt 12 extended and stretched by the rollers. The photosensitive drum 4 of each of the first to fourth process cartridges P (PY to PK) is contacted to an upper surface of the transfer belt 12 at its lower surface. A resultant contact portion is a primary transfer portion. Inside the transfer belt 12, primary transfer rollers 16 are disposed opposed to the associated photosensitive drums 4. Oppositely to the turn roller 14, a secondary transfer roller 17 is disposed in contact with the transfer belt 12. A resultant contact portion between the transfer belt 12 and the secondary transfer roller 17 is a secondary transfer portion.

Below the belt unit 11, a sheet feeding unit 18 is disposed. This sheet feeding unit 18 includes a sheet feeding tray 19 in which sheets of the recording material S are stacked, and includes a sheet feeding roller 20 and the like.

In an upper left side of the apparatus main assembly 2, a fixing unit 21 and a sheet discharging unit 22 are provided. At an upper surface of the apparatus main assembly 2, a sheet discharge tray 23 is defined.

On the recording material S, the toner image is fixed by the fixing unit 21, and then the recording material S is discharged onto the discharge tray 23.

Next, an image forming operation for forming a full-color image will be described. The photosensitive drums 4 of the first to fourth cartridges P (PY to PK) are rotationally driven at a predetermined speed (in an arrow D direction in FIG. 3 and in a counterclockwise direction in FIG. 2). The transfer belt 12 is also rotationally driven in the same direction (arrow C direction in FIG. 2) as the rotational direction of the photosensitive drums 4 (at their contact portions) at a speed corresponding to the speed of the photosensitive drums 4.

The scanner unit LB is also driven. In synchronism with the drive of the scanner unit LB, the surface of the photosensitive drum 4 of each cartridge P is uniformly charged to a predetermined polarity and a predetermined potential by the charging roller 5. The scanner unit LB scans and exposes the surface of each photosensitive drum 4 with the laser light Z depending on an image signal for an associated color. As a result, the electrostatic image depending on the image signal for the associated color is formed on the surface of each photosensitive drum 4. The thus formed electrostatic image is developed by the developing roller 6 which is rotationally driven (in an arrow E direction in FIG. 3 or in the clockwise direction in FIG. 2) at a predetermined speed.

By the electrophotographic image forming process operation as described above, on the photosensitive drum 4 of the first cartridge PY, a yellow toner image corresponding to a yellow component for the full-color image is formed. Then, the toner image is primary-transferred onto the transfer belt 12.

Similarly, on the photosensitive drum 4 of the second cartridge PM, a magenta toner image corresponding to a magenta component for the full-color image is formed. Then, the toner image is primary-transferred superposedly onto the yellow toner image which has already been transferred on the transfer belt 12.

Similarly, on the photosensitive drum 4 of the third cartridge PC, a cyan toner image corresponding to a cyan component for the full-color image is formed. Then, the toner image is primary-transferred superposedly onto the yellow and magenta toner images which have already been transferred on the transfer belt 12.

Similarly, on the photosensitive drum 4 of the fourth cartridge PK, a black toner image corresponding to a black component for the full-color image is formed. Then, the toner image is primary-transferred superposedly onto the yellow, magenta and cyan toner images which have already been transferred on the transfer belt 12.

In this way, unfixed toner images of yellow, magenta, cyan and black for the four color-based full-color image are formed on the transfer belt 12.

On the other hand, at predetermined control timing, sheets of the recording material S are separated and fed one by one. The recording material S is introduced into a secondary transfer portion which is a contact portion between the secondary transfer roller 17 and the transfer belt 12 with predetermined control timing. As a result, in a process in which the recording material S is conveyed to the secondary transfer portion, the four color toner images superposed on the transfer belt 12 are collectively transferred onto the surface of the recording material S.

FIG. 4 is a perspective view showing a structure of each of the cartridges P (PY to PK). As shown in FIG. 4, the cartridge P has an elongated shape extending in a longitudinal direction which is a direction of a rotational axis a of the photosensitive drum 4, and includes the cleaning unit 8 and the developing unit 9. In the cartridge P, a shaft of the photosensitive drum 4 is supported at its end portion by a driving-side cover member (first cover member) and is supported at its another end portion by a non-driving-side cover member (second cover member). Further, a cleaning device frame 66 is supported by the first cover 24 and the second cover 25. A drum supporting apparatus 91 (FIG. 8) will be described later but it can be said that the drum supporting apparatus 91 is a mechanism provided inside such a cartridge P.

FIG. 3 is a sectional view showing the structure of each of the cartridges P (PY to PK). As shown in FIG. 3, the cartridge P includes the developing unit 9 and the cleaning unit 8. The developing unit 9 includes the frame 29. Inside the frame 29, the developing roller 6 and a supplying roller 33 are provided. Further, at an opening of the frame 29, a developing blade 37 is mounted.

The cleaning unit 8 includes the cleaning frame 66. Inside the frame 66, the photosensitive drum 4 and the charging roller 5 are provided. Further, on the frame 66, a cleaning blade 7 is mounted.

The photosensitive drum supporting apparatus 91 for supporting the photosensitive drum 4 is provided in the cleaning unit 8.

The photosensitive drum 4 obtains a driving force of a motor (not shown) of the apparatus main assembly 2 from a driving coupling 51*a* (FIG. 8) provided on a first flange 51 (FIG. 8) fixed at an end portion of the photosensitive drum 4 with respect to a rotational axis direction of the photosensitive drum 4, and thus is rotationally driven (in the arrow D direction).

The charging roller 5 is rotatably supported at its end portions by charging roller bearings 27 of the frame 66 and is driven by rotation of the photosensitive drum 4 in contact with the surface of the photosensitive drum 4. At this time, in order to uniformly charge the surface of the photosensitive drum 4, the charging roller 5 is urged toward the photosensitive drum 4 by an urging spring 28.

The blade 7 is fixed on the frame 66, and an elastic rubber end portion thereof is disposed in contact with the photosensitive drum 4 in a direction counterdirectionally to the rotational direction (the arrow D direction in FIG. 3). During image formation, the blade 7 scrapes off a transfer residual toner remaining on the photosensitive drum 4 to clean the surface of the photosensitive drum 4. At this time, the end of the blade 7 is contacted to the surface of the photosensitive drum 4 at predetermined pressure in order to scrape off the transfer residual toner completely.

Further, the transfer residual toner scraped off from the surface of the photosensitive drum 4 by the blade 7 is accommodated as a waste (residual) toner in a residual toner accommodating chamber 66*n* through an opening 66*m*. For that purpose, on the frame 66, a residual toner collecting sheet member 35 for preventing the residual toner from leaking out from a gap between itself and the photosensitive drum 4 or the blade 7 is fixed with respect to the longitudinal direction of the photosensitive drum 4. Further, at each of longitudinal end portions of the blade 7, an end portion seal member (not shown) is provided.

Figure 5:
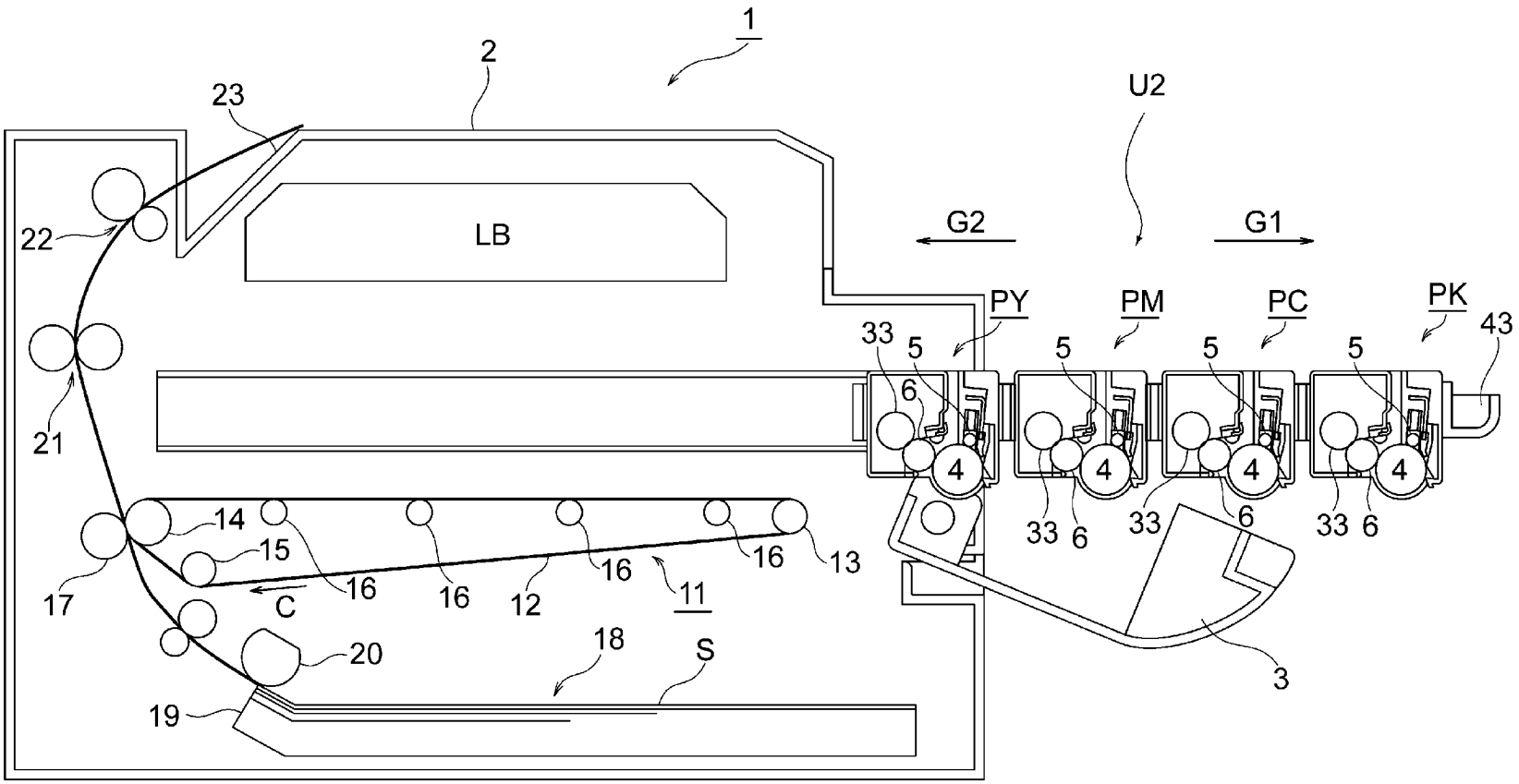
FIG. 5 is a sectional view showing a state in which a tray is pulled out from an apparatus main assembly.
Figure 6:
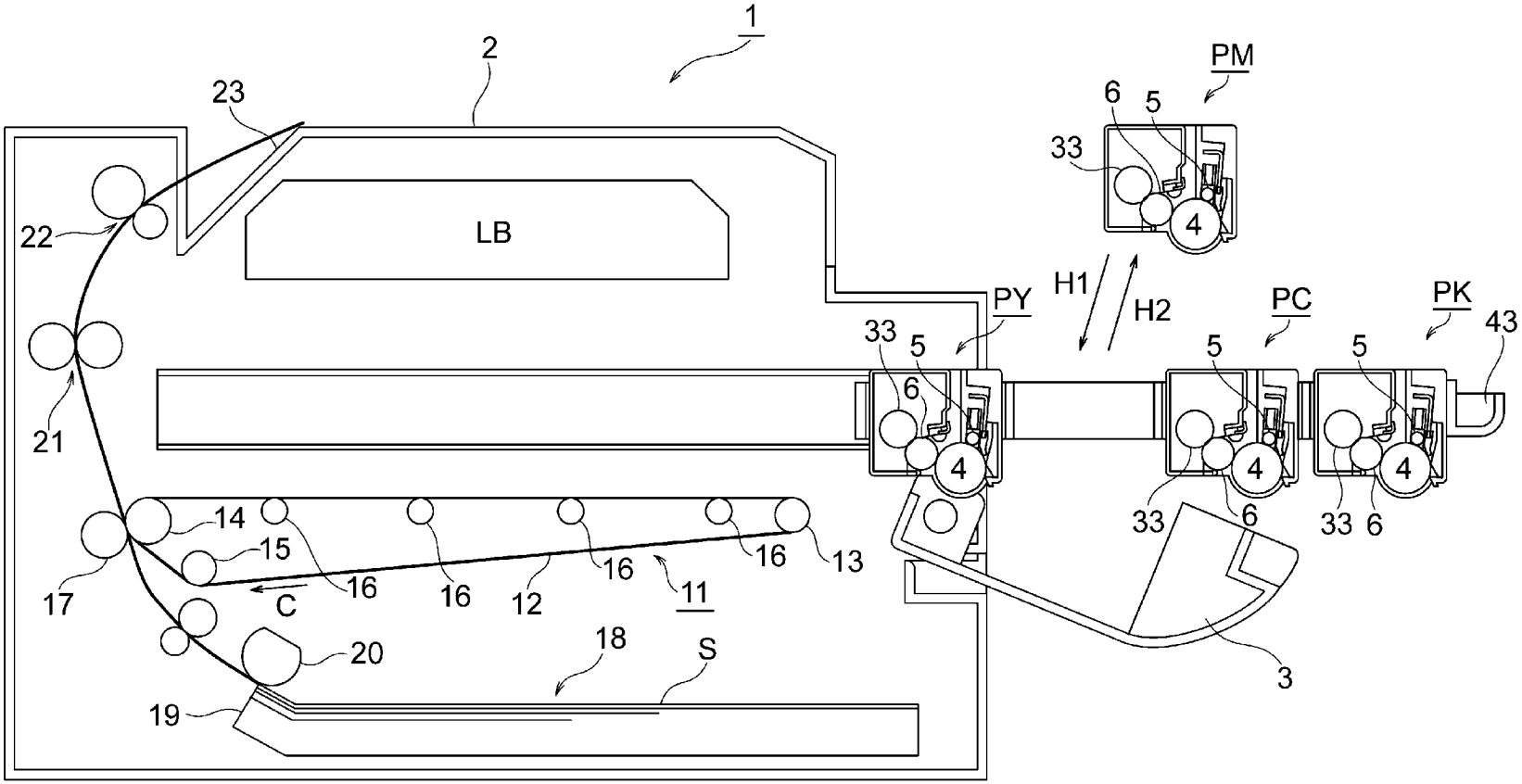
FIG. 6 is a sectional view for illustrating a demounting and mounting operation of the cartridge with respect to the tray.

FIG. 5 is a sectional view showing a state in which a cartridge tray 43 is pulled out from the apparatus main assembly 2. FIG. 6 is a sectional view for illustrating an operation by which the cartridge PM is demounted from and mounted into the tray 43. While referring to FIGS. 5 and 6, the operation for demounting and mounting the cartridge P (PY to PK) with respect to the apparatus main assembly 2 will be described.

As shown in FIG. 5, inside the apparatus main assembly 2, the tray 43 in which the cartridges P are mountable is provided. The tray 43 is constituted so as to be linearly movable (pullable and pushable) in a pulling-out direction G1 and a mounting direction G2, which are the horizontal direction, with respect to the apparatus main assembly 2. Further, the tray 43 is capable of being located at an inside position U1 (FIG. 2) where the tray 43 is pushed in the apparatus main assembly 2 and at an outside position U2 (FIG. 5) where the tray 43 is pulled out from the inside position U1.

An operation in which the used cartridges P (PY to PK) are demounted from the apparatus main assembly 2 and then new (fresh) cartridges P (PY to PK) are mounted in the apparatus main assembly 2 will be described. A user opens the openable door 3 and then moves the tray 43 in the pulling-out direction G1 to the outside position U2. Then, as shown in FIG. 6, in this state, the user moves, e.g., the used cartridge PM in an arrow H2 direction to demount the cartridge PM from the tray 43, and thereafter the user moves a new cartridge PM in an arrow H1 direction to hold the cartridge PM in the tray 43. Then, as shown in FIG. 5, the user moves the tray in the mounting direction G2 to the inside position U1. The user closes the openable door 3, thus completing a mounting operation of the cartridges P in to the apparatus main assembly 2. By these operations, the cartridges P (PY to PK) are demountable from and mountable into the apparatus main assembly 2. Then, a constitution of the cleaning unit 8 including the drum supporting apparatus 91 will be described.

Figure 7:
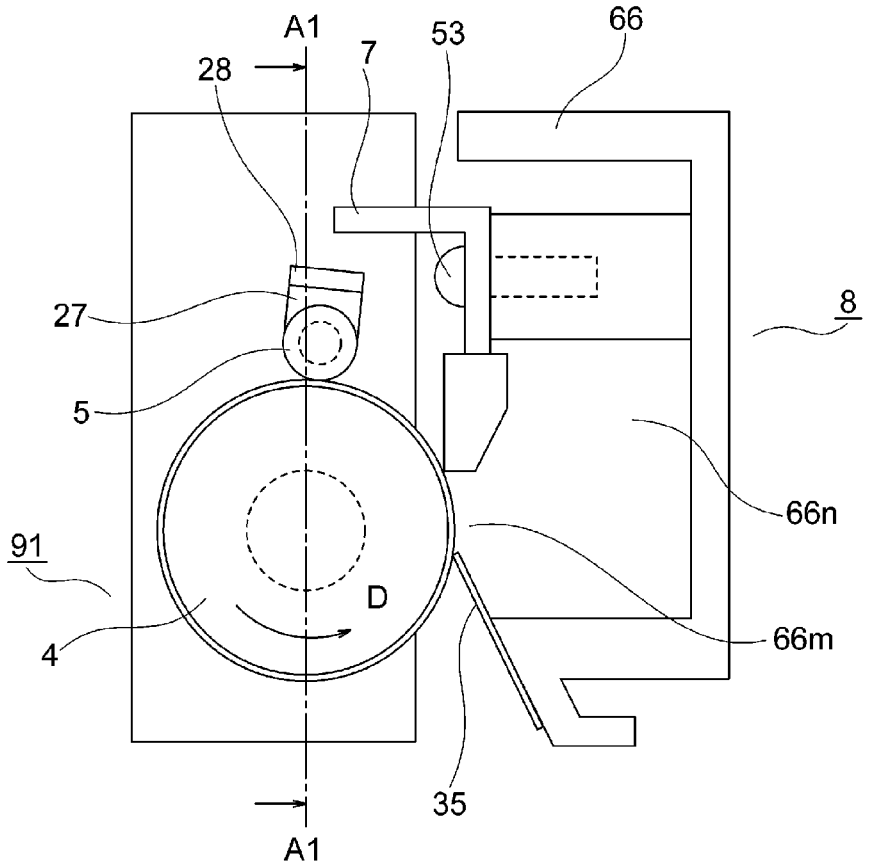
FIG. 7 is a sectional view showing a structure of a cleaning unit.
Figure 8:
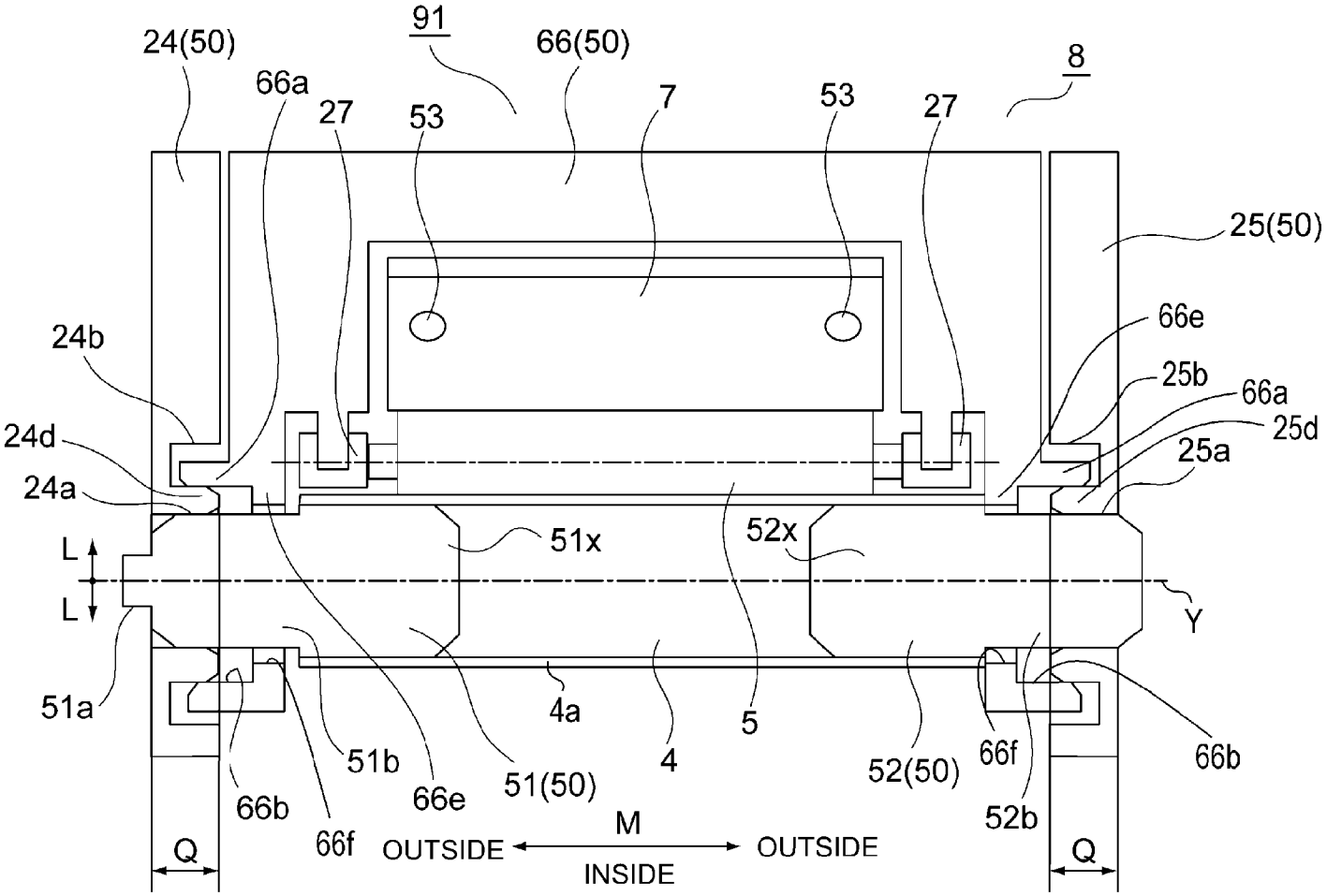
FIG. 8 is a sectional view taken along A1-A1 line in FIG. 7.

FIG. 7 is a sectional view showing a structure of the cleaning unit 8. FIG. 8 is a sectional view of the cleaning unit 8 taken along A1-A1 line indicated in FIG. 7. As shown in FIG. 7, in the cleaning unit 8, the blade 7 is fixed on the frame 66 with a screw 53. Further, as shown in FIG. 8, the charging roller 5 is supported at its end portions by the bearings 27 supported by the frame 66, and is urged toward the photosensitive drum 4 by urging springs 28 (FIG. 7). Further, as shown in FIG. 7, the frame 66 is provided with the opening 66*m* through which the residual toner is to be collected, and includes the residual toner accommodating chamber 66*n* for accommodating the residual toner. Further, on the frame 66, the residual toner collecting sheet member 35 for preventing leaking out of the residual toner is mounted so as to oppose the photosensitive drum 4 along the surface of the photosensitive drum 4 with respect to the longitudinal direction.

While referring to FIG. 8, the structure of the drum supporting apparatus 91 will be described. As shown in FIG. 8, the drum supporting apparatus 91 includes the frame 66, the first cover 24 and the second cover 25. The frame 66 is a member for holding (supporting) the first cover 24 and the second cover 25. The first cover 24 as a first supporting member is a member for rotatably supporting an end portion of the shaft of the photosensitive drum 4 at first supporting portion 24*a*. The second cover 25 as a second supporting member is a member for rotatably supporting another end portion of the shaft of the photosensitive drum 4 at a second supporting portion 25*a*.

With the frame 66, the first cover 24 is assembled in a left side of a rotational axis direction M, and the second cover 25 is assembled in a right side of the rotational axis direction M. That is, with respect to the rotational axis direction M (longitudinal direction) of the photosensitive drum 4, the first cover 24 and the second cover 25 are provided in an end side and another end side of the drum supporting apparatus 91, respectively. Inside those frame 66, first cover 24 and second cover 25, the photosensitive drum 4 is disposed. The photosensitive drum 4 includes a drum member 4*a* formed in a cylindrical shape, and a first flange 51 (driving-side drum flange) and a second flange 52 (non-driving-side drum flange) which are engaged in the drum member 4*a*. The first flange 51 is supported by the first cover 24, and the second flange 52 is supported by the second cover 25.

The first flange 51 is engaged in the drum member 4*a* at the end portion with respect to the rotational axis direction M to support the end portion of the drum member 4*a*, and the second flange 52 is engaged in the drum member 4*a* at another end portion with respect to the rotational axis direction M to support another end portion of the drum member 4*a*.

The first flange 51 includes a base end portion 51*x*, having a large diameter, engaged in the drum member 4*a*. Further, the first flange 51 includes a first shaft portion 51*b* as a first supported portion which is formed, in a smaller diameter than the diameter of the base end portion 51*x*, outside the base end portion 51*x* with respect to the rotational axis direction M and which is supported by the first cover 24. Further, the first flange 51 includes a driving coupling 51*a* formed outside the first shaft portion 51*b* with respect to the rotational axis direction M in a diameter smaller than the diameter of the first shaft portion 51*b*.

The second flange 52 includes a base end portion 52*x*, having a large diameter, engaged in the drum member 4*a*. Further, the second flange 52 includes a second shaft portion 52*b* as a second supported portion which is formed, in a smaller diameter than the diameter of the base end portion 52*x*, outside the base end portion 52*x* with respect to the rotational axis direction M and which is supported by the second cover 25.

The first shaft portion 51*b* of the first flange 51 is rotatably supported by the first supporting portion 24*a* formed on the first cover 24. The second shaft portion 52*b* of the second flange 52 is rotatably supported by the second supporting portion 25*a* formed on the second cover 25. As a result, the photosensitive drum 4 is rotatably supported.

Here, the first flange 51 side is the driving side of the drum supporting apparatus 91, and the second flange 52 side is the non-driving side of the drum supporting apparatus 91. When the rotational axis direction M of the photosensitive drum 4 is the longitudinal direction, portions in the driving side and the non-driving side provide a symmetrical shape with respect to a longitudinal central portion except that the driving coupling 51*a* is provided in the driving side. For that reason, the portions in the driving side and the non-driving side have substantially the same structure, and therefore in the following, the driving-side structure will be principally described, and the description thereof is also applicable to that of the non-driving-side structure.

Figure 9:
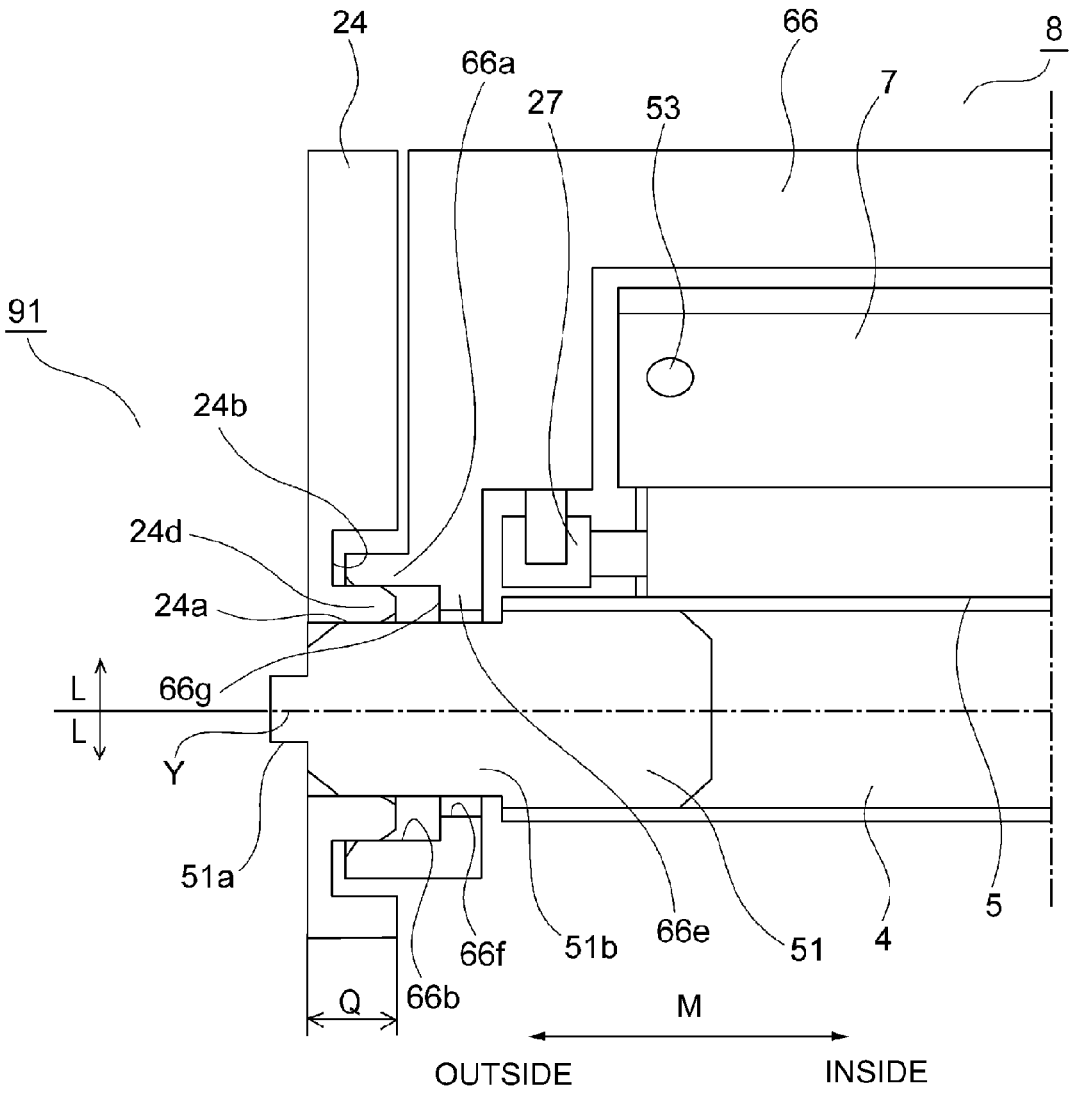
FIG. 9 is an enlarged sectional view showing a left-side portion of FIG. 8.

FIG. 9 is an enlarged sectional view showing a structure of a left-side portion of FIG. 8. As shown in FIG. 9, the frame 66 includes a first frame supporting portion 66*a*. The first frame supporting portion 66*a* extends toward the outside of the rotational axis direction M to support the first cover 24. Further, the first frame supporting portion 66*a* includes a first frame arcuate portion 66*b*, at its inner peripheral surface, for covering an outer peripheral surface of the first shaft portion 51*b*. The first frame arcuate portion 66*b* is a curved surface portion having a curved line shape (arcuate shape in this embodiment) cured curved along the outer peripheral surface of the first shaft portion 51*b*.

A first arcuate rib 66*e* as a first spacing maintaining portion is formed on the first frame arcuate portion 66*b* and extends toward the outer peripheral surface of the first shaft portion 51*b*, thus opposing the outer peripheral surface of the first shaft portion 51*b* with respect to a radial direction L. Also the first arcuate rib 66*e* has, similarly as the first frame arcuate portion 66*b*, a curved line shape curved along the first shaft portion 51*b*. Further, the first arcuate rib 66*e* has, its inner peripheral surface, a contact surface 66*f* opposing the outer peripheral surface of the first shaft portion 51*b*. The first arcuate rib 66*e* is formed and disposed outside the first shaft portion 51*b* with respect to the radial direction L. The first arcuate rib 66*e* is formed inside, with respect to the rotational axis direction (longitudinal direction) M, a supporting range Q in which the first supporting portion 24*a* supports (is capable of supporting) the first shaft portion 51*b*. The first arcuate rib 66*e* (particularly a rib height or a rib thickness) is formed in height (thickness) larger than a height a1 of the lubricant 90 to be applied onto the first shaft portion 51*b*, so that a spacing (gap) is formed between the first frame arcuate portion 66*b* and the first shaft portion 51*b* (as will be specifically described later). Inside the first frame arcuate portion 66*b* with respect to the radial direction, the first arcuate rib 66*e* is provided.

Incidentally, in a structure in the second flange 52 side shown in FIG. 8, a second arcuate rib 66*e* as a second spacing maintaining portion is formed on the second frame arcuate portion 66*b* and extends toward the outer peripheral surface of the second shaft portion 52*b*, thus opposing the outer peripheral surface of the second shaft portion 52*b* with respect to a radial direction L. The second arcuate rib 66*e* is formed (disposed) outside the second shaft portion 52*b* with respect to the radial direction L. The second arcuate rib 66*e* is formed inside, with respect to the rotational axis direction M, a supporting range Q in which the second supporting portion 25*a* supports (is capable of supporting) the second shaft portion 52*b* (FIG. 8). The second arcuate rib 66*e* (particularly a rib height or a rib thickness) is formed in height (thickness) larger than a height a1 of the lubricant 90 to be applied onto the second shaft portion 52*b*, so that a spacing (gap) is formed between the second frame arcuate portion 66*b* and the second shaft portion 52*b* (as will be specifically described later). Inside the second frame arcuate portion 66*b* with respect to the radial direction, the second arcuate rib 66*e* is provided.

Next, a supporting constitution of the first cartridge 24 and the second cartridge 25 with respect to the frame 66 will be described. The above-described frame 66 includes a first frame supporting portion (first projection) 66*a* as a first engaging portion. The first frame supporting portion 66*a* is disposed outside the first shaft portion 51*b* with respect to the radial direction L of the photosensitive drum 4, and extends toward an outside of the first arcuate rib 66*e* with respect to the rotational axis direction M of the photosensitive drum 4. Further, the frame 66 includes a second frame supporting portion (second projection) 66*a* that extends, outside the second shaft portion 52*b* with respect to the radial direction L, toward an outside of the second arcuate rib 66*e* with respect to the rotational axis direction M of the photosensitive drum 4. The second frame supporting portion 66*a* is a second engaging portion.

On the other hand, the first cover 24 includes a first groove 24*b* to be engaged with the first frame supporting portion 66*a*. The first groove 24*b* is a first recessed portion and is an engaging portion in the first cover 24 side. The first groove is recessed toward the outside of the rotational axis direction M. The first frame supporting portion 66*a* engages with the first groove 24*b*. On the first cover 24, a boss 24*d*, closer to the first shaft portion 51*b* than the first groove 24*b*, extending toward the inside of the rotational axis direction M is formed. The first frame arcuate portion 66*b* is engaged with and supported by an outer peripheral surface of the boss 24*d*. The second cover 25 is provided with a second groove 25*b* as a second recessed portion with which the second frame supporting portion 66*a* is engaged. The second groove 25*b* is recessed toward the outside of the rotational axis direction M. The function and constitution of the second groove 25*b* and a boss 25*d* are the same as the first groove 25*b* and the boss 24*d*.

Figure 1:
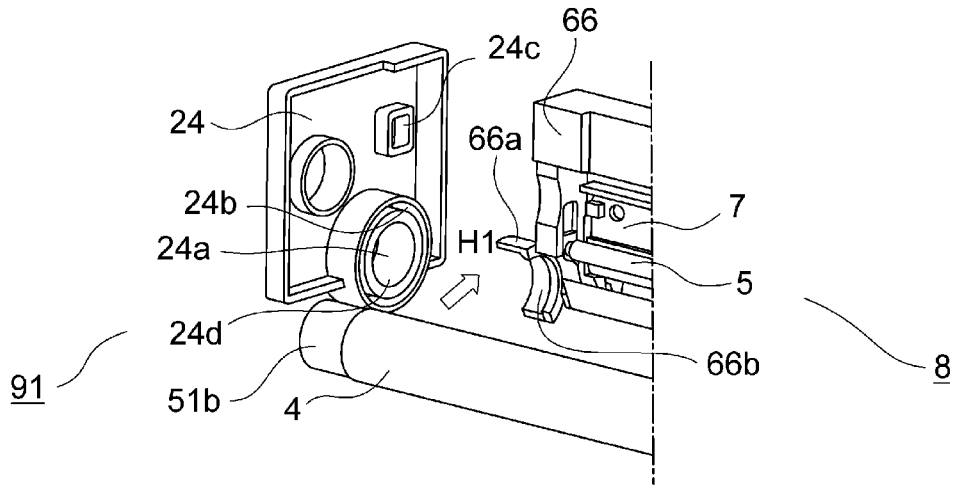
Figure 1:
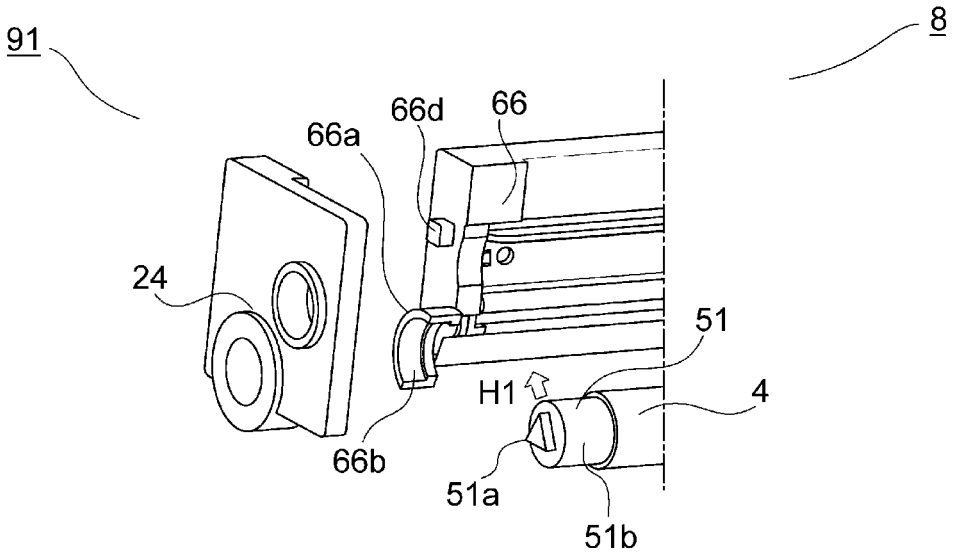
Figure 10:
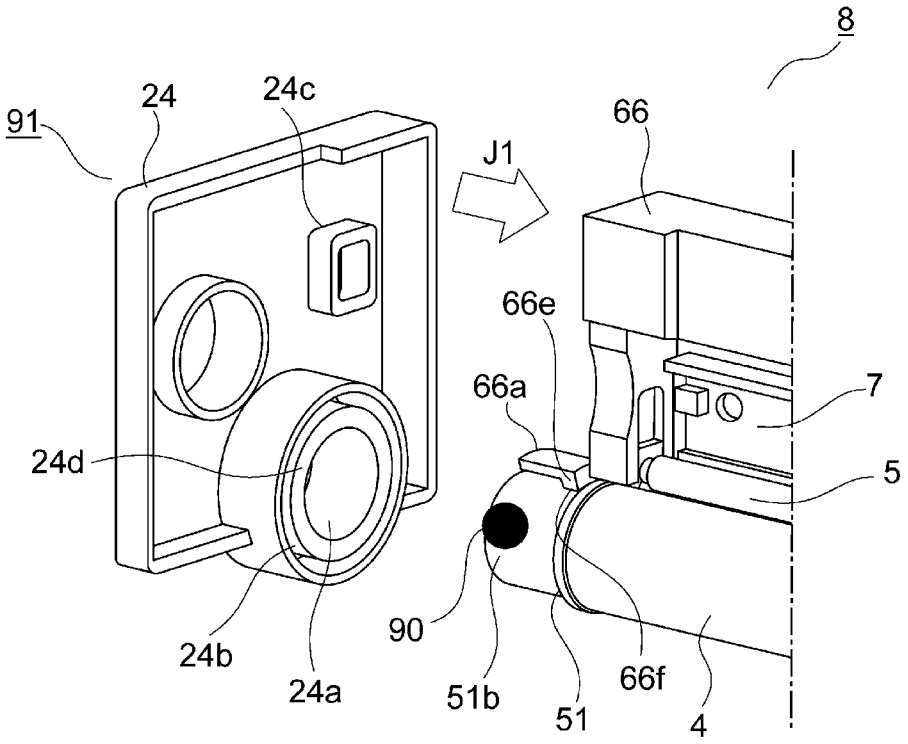
FIG. 10 is an exploded perspective view in a driving side.

Parts (a) and (b) of FIG. 1 are exploded perspective view of FIG. 9. FIG. 10 is an exploded perspective view of the driving-side portion. As shown in FIGS. 1 and 10, a boss 66*d* ((b) of FIG. 1) is formed on the frame 66, and the first cover 24 is provided with an elongated circular hole 24*c* ((a) of FIG. 1). The boss 66*d* is engaged in the elongated circular hole 24*c*. As a result, a position and attitude of the first cover 24 relative to the frame 66 are determined. By the constitution described above, the photosensitive drum 4 is positioned relative to the frame 66 with high accuracy.

Figure 11:
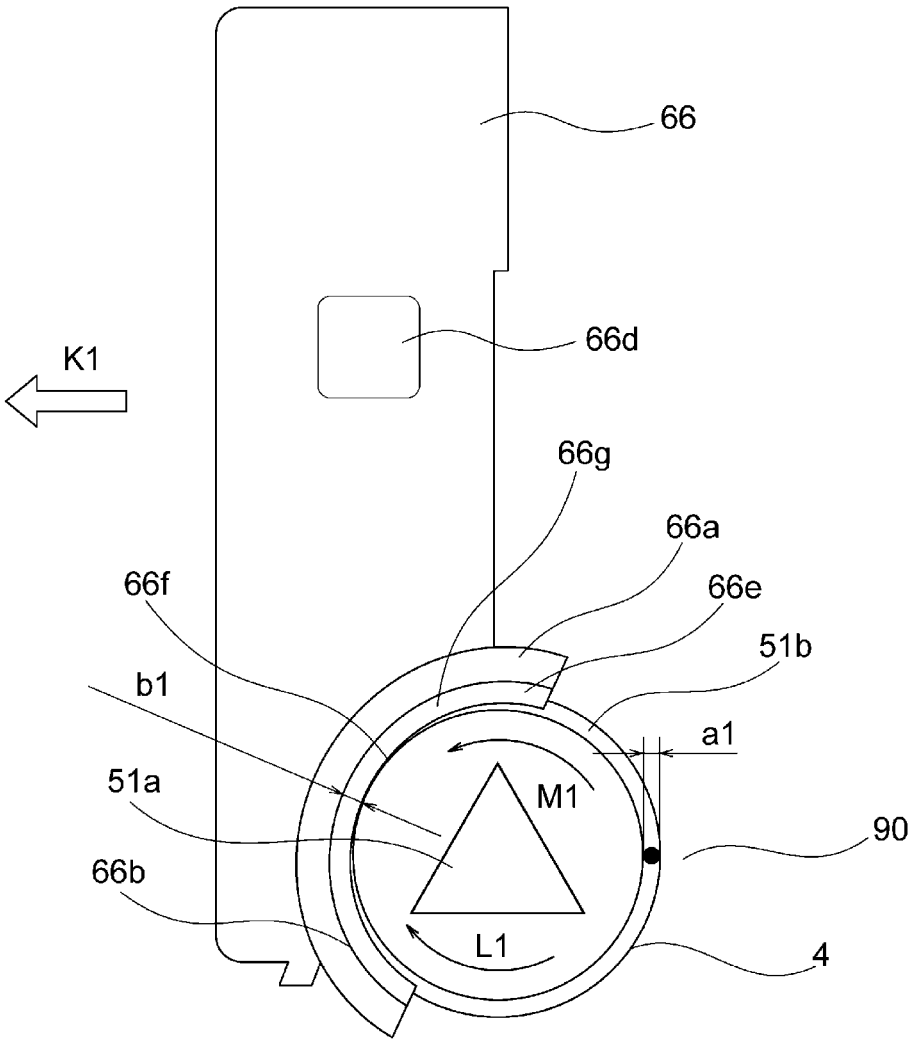
FIG. 11 is a side view as seen from an arrow J1 direction in FIG. 10.
Figure 12:
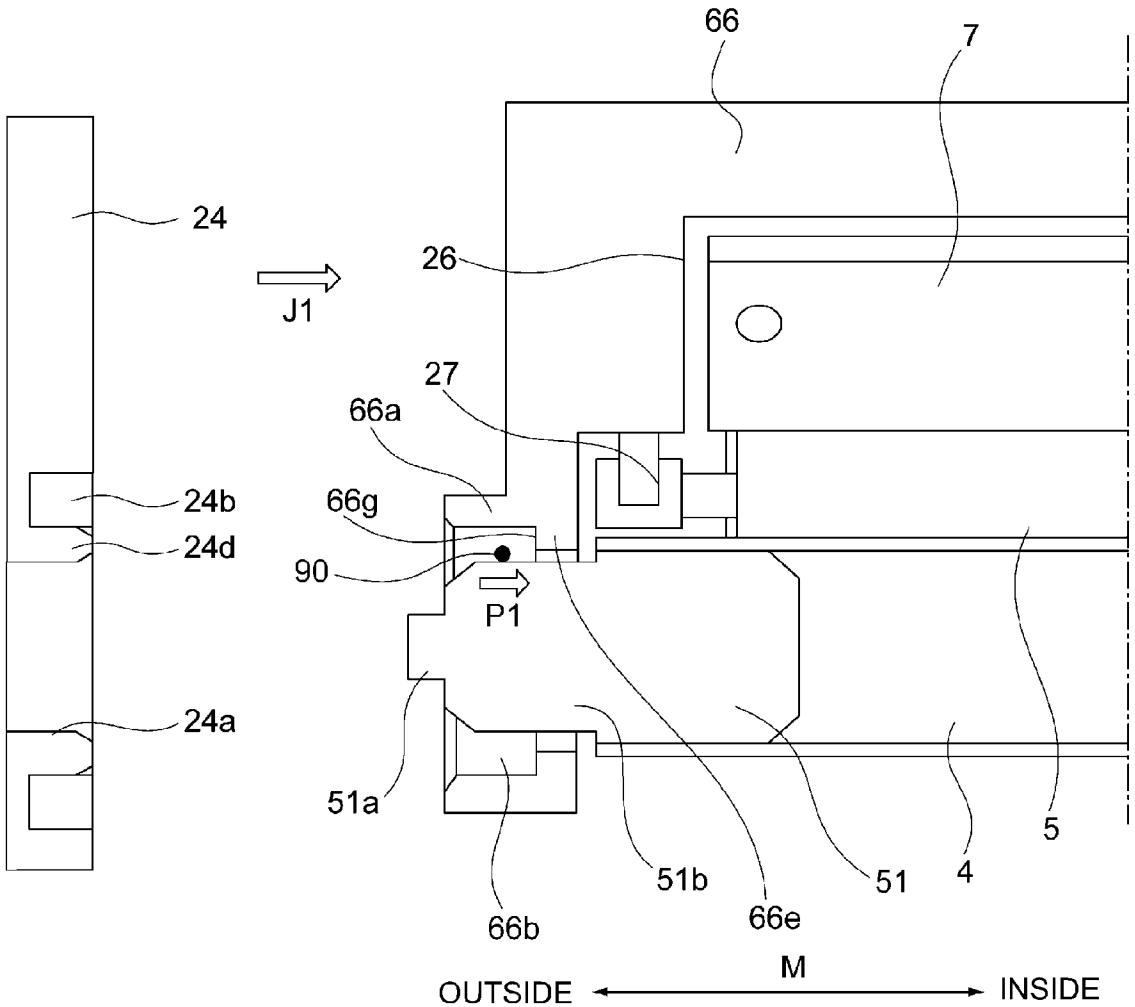
FIG. 12 is a sectional view showing a process in which a first cover is assembled with a frame in a state of FIG. 11.

FIG. 11 is a side view as seen from an arrow J1 direction indicated in FIG. 10. FIG. 12 is a sectional view showing a process in which the first cover 24 is assembled with the frame 66 from the state of FIG. 10. While referring to these FIGS. 11 and 12, assembling of the cleaning unit 8 including the drum supporting apparatus 91 will be described. The photosensitive drum 4 is assembled toward the frame arcuate portion 66*b* in an arrow H1 direction (FIG. 1), so that the photosensitive drum 4 is temporarily placed on the frame 66 as shown in FIG. 11. This case can be regarded as the case where there is no first supporting portion 24*a* in the first flange 51 side, and in this case, the first arcuate rib 66*e* supports a part of the outer peripheral surface of the first shaft portion 51*b*. In the second flange 52 side, there is no second supporting portion 25*a*, and in this case, the second arcuate rib 66*e* supports a part of the outer peripheral surface of the second shaft portion 52*b*.

As shown in FIG. 11, in a state in which the photosensitive drum 4 is temporarily placed on the frame 66, the photosensitive drum 4 is not positioned relative to any portion. For that reason, the photosensitive drum 4 is temporarily placed, so as not to be demounted and dropped from the frame 66, in a state in which an arrow K1 direction is directed downward.

As shown in FIGS. 8, 9 and 1, the above-described first arcuate rib 66*e* has a projected shape at the surface of the first frame supporting portion 66*a* so that the first arcuate rib 66*e* is located inside, with respect to the rotational axis direction M, the engaging surface where the first frame arcuate portion 66*b* is engaged in the first groove 24*b* and extends toward the rotation center Y. Therefore, as described above with reference to FIG. 11, when the photosensitive drum 4 is temporarily placed on the frame 66 in the state in which the arrow K1 direction is directed downward, by the self-weight of the photosensitive drum 4, the first shaft portion 51*b* of the first flange 51 contacts a contact surface 66*f* defined at an inner peripheral surface of the arcuate rib 66*e*.

Here, during image formation, the first shaft portion 51*b* and the first supporting portion 24*a* slide with each other, and therefore the lubricant 90 is applied in the following manner (FIG. 10). The lubricant 90 is applied onto the first shaft portion 51*b* at the outer peripheral surface of a portion (sliding surface) outside, with respect to the rotational axis direction M which is the longitudinal direction of the photosensitive drum 4, a portion where the first shaft portion 51*b* opposes the contact surface 66*f* (sliding surface) of the first arcuate rib 66*e* (FIG. 12). Similarly, the lubricant 90 is applied onto the second shaft portion 52*b* of the outer peripheral surface of a portion outside, with respect to the rotational axis direction M of the photosensitive drum 4, a portion where the second shaft portion 52*b* opposes the second surface 66*f* (sliding surface) of the second arrow 66*e*.

Further, as shown in FIGS. 11 and 12, the lubricant 90 is applied onto the outer peripheral surface of the first shaft portion 51*b* at a position opposite from the position where the first shaft portion 51*b* opposes the first frame arcuate portion 66*b* along a circumferential direction. On the other hand, the photosensitive drum 4 is in a temporarily placed state, so that the photosensitive drum 4 is rotatable in an arrow L1 direction and an arrow M1 direction in FIG. 11.

However, when a distance (gap) between the first shaft portion and the first frame arcuate portion 66*b* is b1 and a height of the lubricant is a1, b1 and a1 are set to satisfy a relationship of: b1>a1. As a result, even when the lubricant 90 is located at any position on the circumferential outer peripheral surface of the first shaft portion 51*b* by rotation of the photosensitive drum 4, the lubricant 90 is prevented from adhering to the first frame arcuate portion 66*b*.

Further, from this state, the first cover 24 is assembled with (mounted on) the frame 66 from the arrow J1 direction as shown in FIG. 12. At this time, in some cases, by the boss 24*d* provided on the first cover 24, the lubricant 90 is pushed into the inside of the rotational axis direction M in an arrow P1 direction in FIG. 12.

Figure 13:
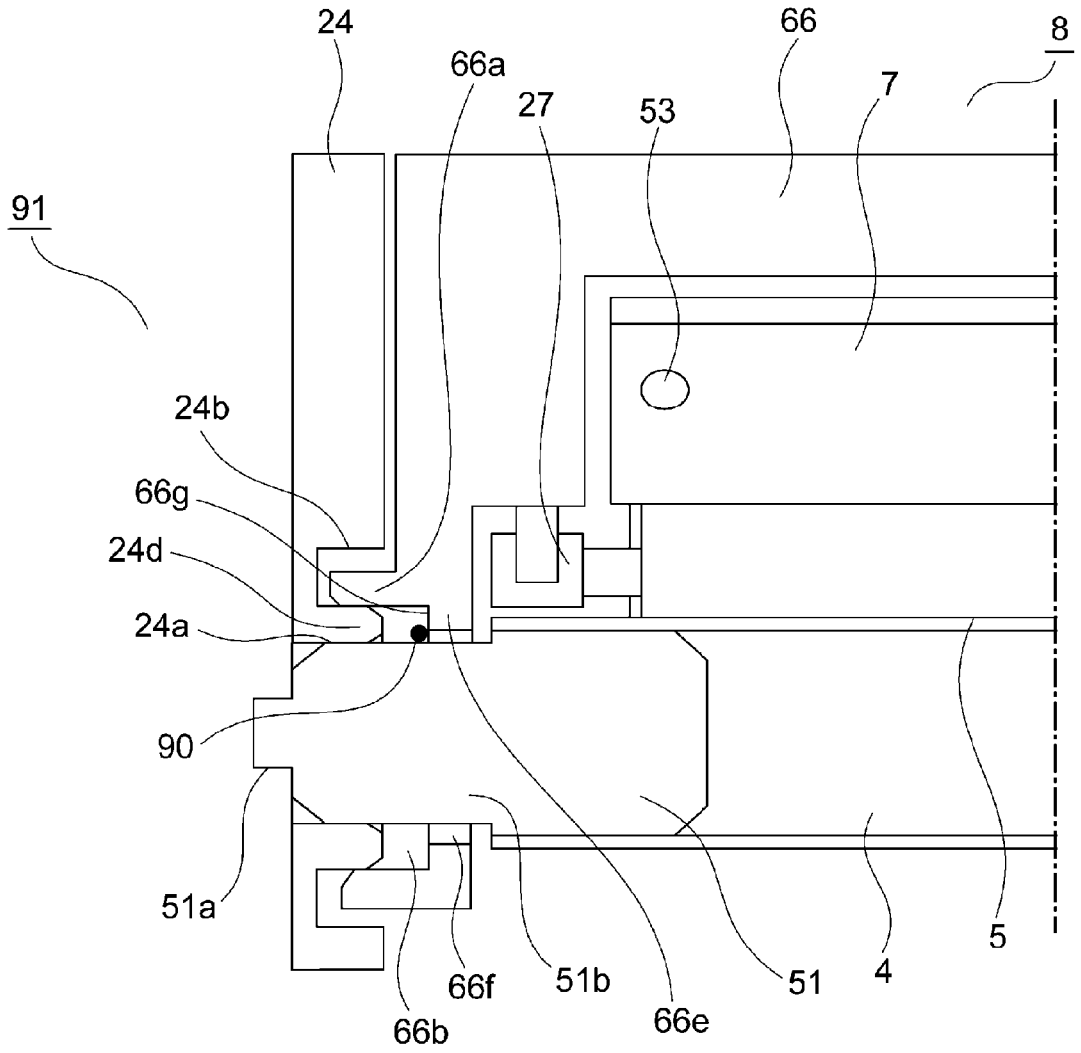
FIG. 13 is a sectional view showing a state in which the first cover is assembled with the frame in the state of FIG. 11.

However, as shown in FIG. 13, the lubricant 90 is blocked by an end surface 66*g* of the first arcuate rib 66*e*, so that an amount of the lubricant 90 entering a gap between the first arcuate rib 66*e* and the first shaft portion 51*b* is slight. For that reason, it is possible to suppress pushing-in of the lubricant 90 toward the inside the first arcuate rib 66*e* with respect to the rotational axis direction M. As a result, it is possible to suppress and prevent an occurrence of a phenomenon that the lubricant 90 adheres to the surface of the photosensitive drum 4 at a position inside the first arcuate rib 66*e*. In a state in which the first cover 24 and the second cover 25 are mounted on the frame 66, the contact surface 66*f* of the first arcuate rib 66*e* is spaced from the first shaft portion 51*b* and the second shaft portion 52*b*. For this reason, when the photosensitive drum 4 is rotated, the first arcuate rib 66*e* does not obstruct the rotation of the photosensitive drum 4.

According to the above-described constitution of Embodiment 1, in the state in which the first cover 24 and the second cover 25 are not mounted on the frame 66, the photosensitive drum 4 is temporarily placed on the first arcuate rib 66*e* and the second arcuate rib 66*e* of the frame 66. In this state, by the first arcuate rib 66*e* and the second arcuate rib 66*e*, a spacing is maintained between the first frame arcuate portion 66*b* of the frame 66 and the first and second shaft portions 51*b* and 52*b* of the photosensitive drum 4. Therefore, the lubricant 90 applied onto the respective shaft portions is prevented from adhering to an unnecessary place such as the first frame arcuate portion 66*b* or the like. Further, when the first cover 24 is assembled with the frame 66, the lubricant 90 is prevented from adhering to the surface of the photosensitive drum 4. Therefore, the photosensitive drum 4 is temporarily placed on the frame 66 and then the first cover 24 is assembled with the frame 66, so that it is possible to supply the lubricant 90 in a necessary amount to the first shaft portion 51*b* and the first supporting portion 24*a*.

Incidentally, in Embodiment 1, the constitution of the positioning between the frame 66 and the first cover 24 is described as a constitution in which the first frame arcuate portion 66*b* and the outer peripheral surface of the first supporting portion 24*a* engage with each other. However, a constitution in which the first frame arcuate portion 66*b* is not provided on the frame 66 and thus the frame 66 and the first cover are positioned in another manner may also be employed.

Embodiment 2

Figure 14:
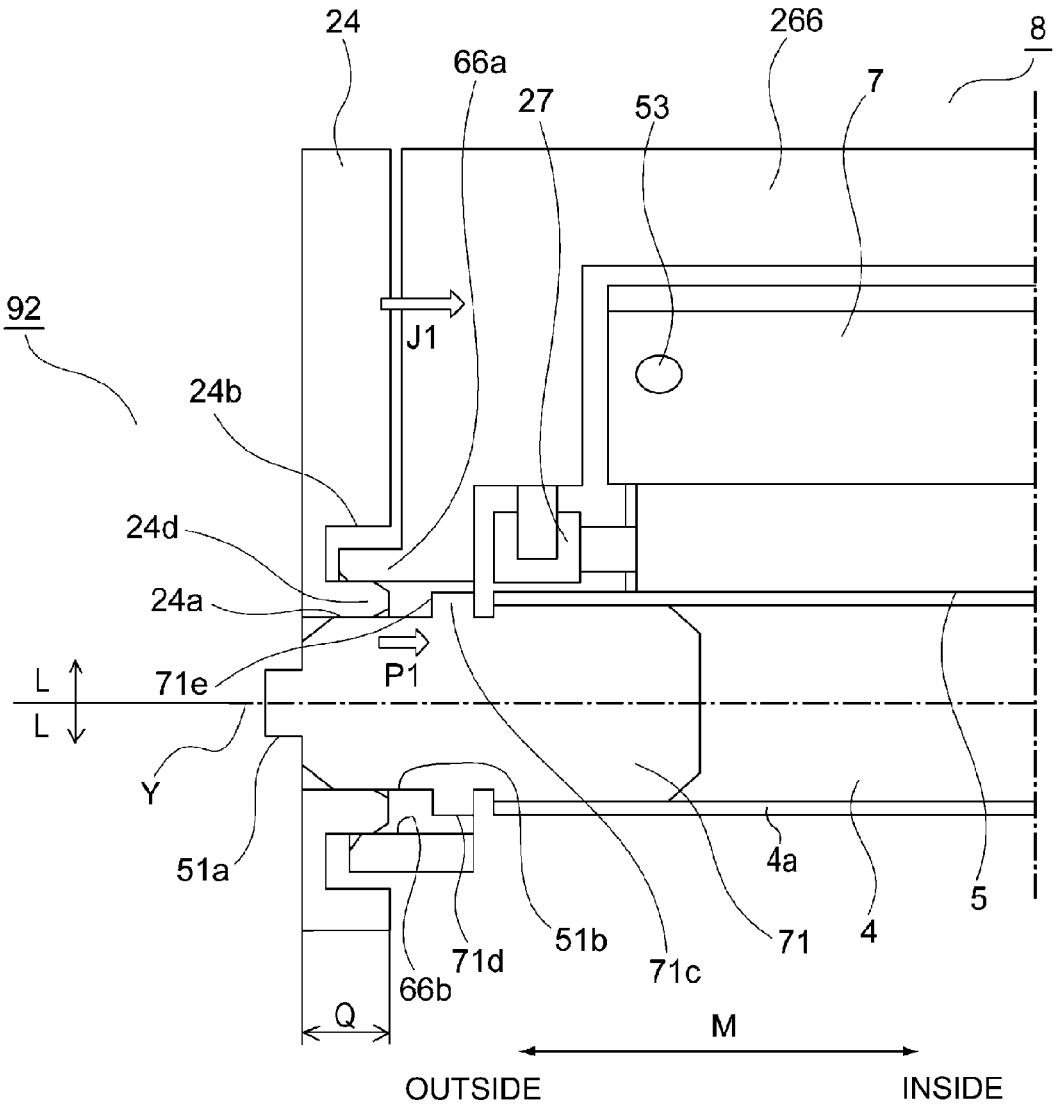
FIG. 14 is a sectional view showing a structure of a drum supporting apparatus in Embodiment 2.
Figure 15:
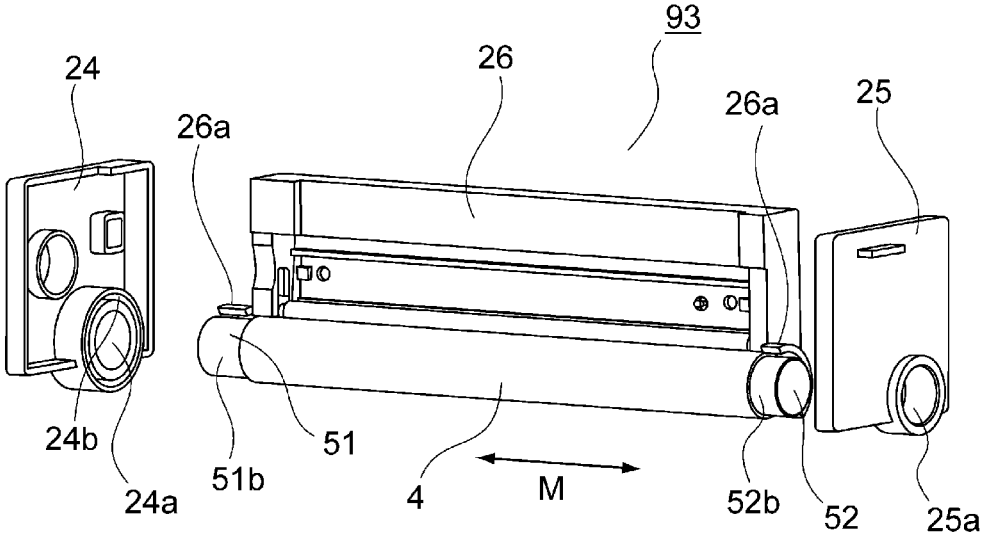
FIG. 15 is an exploded perspective view showing a structure of a photosensitive drum supporting apparatus corresponding to a structure in JP-A 2005-338751.

FIG. 14 is a sectional view showing a structure of a drum supporting apparatus 92 in this embodiment. Of constituent elements of the drum supporting apparatus 92 in this embodiment, those having the same constitutions and effects as those of the drum supporting apparatus 91 in Embodiment 1 are represented by the same reference numerals or symbols and will be appropriately omitted from description. Also in this embodiment, the same image forming apparatus as in Embodiment 1 is applicable, and therefore description of the image forming apparatus will be omitted. Further, similarly as in Embodiment 1, the portions in the driving side and the non-driving side have substantially the same structure, and therefore in the following, the driving-side structure will be principally described, and the description thereof is also applicable to that of the non-driving-side structure. A characteristic portion of the drum supporting apparatus 92 is as follows.

The photosensitive drum 4 includes the drum member 4*a*, the first shaft portion 51*b* of the first flange 51 to be supported by the first cover 24, and the second shaft portion 52*b* of the second flange 52 to be supported by the second cover 25. Further, the photosensitive drum 4 includes a first circumferential rib 71*c* provided in the driving side (one end side) of the photosensitive drum 4 in FIG. 14, and includes a second circumferential rib 71*c* (not shown) provided in the non-driving side (another end side) of the photosensitive drum 5. Both of the first and second circumferential ribs 71*c* draw curves along the outer peripheral surfaces of the first shaft portion 51*b* and the second shaft portion 52*b*, respectively.

The first circumferential rib 71*c* as a third spacing maintaining portion extends toward the outside of the first shaft portion 51*b* with respect to the radial direction L. The first circumferential rib 71*c* is located outside the first shaft portion 51*b* with respect to the radial L of the photosensitive drum 4.

Further, the first circumferential rib 71*c* is formed inside, with respect to the rotational axis direction (longitudinal direction) M of the photosensitive drum 4, a supporting range Q in which the first supporting portion 24*a* supports an end portion-side outer peripheral surface of the first shaft portion 51*b*. The first circumferential rib 71*c* forms a spacing (gap), between the first frame supporting portion 66*a* of a frame 206 and the first shaft portion 51*b*, larger than a height a1 of the lubricant 90 to be applied onto the first shaft portion 51*b*.

The second circumferential rib 71*c* as a fourth spacing maintaining portion extends toward the outside of the second shaft portion 52*b* with respect to the radial direction L, and is formed inside, with respect to the rotational axis direction (longitudinal direction) M of the photosensitive drum 4, a supporting range Q in which the second supporting portion 25*a* supports an end portion-side outer peripheral surface of the second shaft portion 52*b*. The second circumferential rib 71*c* forms a spacing (gap), between the first frame supporting portion 66*a* of the frame 206 and the second shaft portion 52*b*, larger than a height a1 of the lubricant 90 to be applied onto the second shaft portion 52*b*.

By employing such a constitution, when the photosensitive drum 4 is temporarily placed on the frame 266 (cleaning frame), a contact surface 71*d* of the first circumferential rib 71*c* is contacted to the first frame arcuate portion 66*b* by the self-weight of the photosensitive drum 4. Here, the third shaft portion 51*b* and the first supporting portion 24*a* slide with each other, and therefore the lubricant 90 is applied onto the outside of the first circumferential rib 71*c* at the outer peripheral surface, as the sliding surface, of the third shaft portion 51*b*.

As shown in FIG. 14, the above-described first circumferential rib 71*c* has a projected shape at the surface of the first shaft portion 51*b* so that the first circumferential rib 71*c* is located inside, with respect to the rotational axis direction M, the engaging surface where the first frame arcuate portion 66*b* is engaged in the first groove 24*b* and is spaced from the rotation center Y.

By the contact of the first circumferential rib 71*c* with the frame 266 (first frame arcuate portion 66*b*), the spacing is maintained between the third shaft portion 51*b* and the first frame arcuate portion 66*b*.

Therefore, even when the lubricant 90 is located at any position with respect to the circumferential direction on the outer peripheral surface of the first shaft portion 51*b* by rotation of the photosensitive drum 4, the lubricant 90 is prevented from adhering to the first frame supporting portion 66*a*.

Further, from this state, the first cover 24 is assembled with (mounted on) the frame 266 from the arrow J1 direction similarly as the case of FIG. 12. At this time, in the case where the lubricant 90 is located at an opposing position to the first frame supporting portion 66*a*, when the first cover 24 is assembled with the frame 266, the lubricant 90 is pushed into the inside of the rotational axis direction M in an arrow P1 direction in FIG. 12 in some cases.

However, as shown in FIG. 14, the lubricant 90 is blocked by an end surface 71*e*, of the first circumferential rib 71*c*, formed outside the rotational axis direction M.

For that reason, the lubricant 90 is prevented by the end surface 71*e* from being pushed into the inside portion of the rotational axis direction M as described above, so that it is possible to prevent an occurrence of the phenomenon that the lubricant 90 adheres to the surface of the photosensitive drum 4. Further, when the first cover 24 is assembled with the frame 266, the lubricant 90 is prevented from adhering to the surface of the photosensitive drum 4. Therefore, the photosensitive drum 4 is temporarily placed on the frame 266 and then the first cover 24 is assembled with the frame 266, so that it is possible to supply the lubricant 90 in a necessary amount to the first shaft portion 51*b* and the first supporting portion 24*a*.

Incidentally, in Embodiment 2, the constitution of the positioning between the frame 266 and the first cover 24 is described as a constitution in which the first frame arcuate portion 66*b* and the outer peripheral surface of the first supporting portion 24*a* engage with each other. However, a constitution in which the first frame arcuate portion 66*b* is not provided on the frame 266 and thus the frame 266 and the first cover are positioned in another manner may also be employed.

According to the constitution in Embodiment 1 or 2, by a simple assembling method, the lubricant in a necessary amount is supplied to the sliding portion of each of the shaft portions of the photosensitive drum 4, so that the adherence of the lubricant on the surface of the photosensitive drum 4 is suppressed.

Incidentally, in Embodiments 1 and 2, the drum supporting apparatus constituting a part of the cleaning unit is described but the present invention is also applicable to a constitution of the drum supporting apparatus alone or a constitution of a process cartridge including the photosensitive drum supporting apparatus.

Further, in the photosensitive drums 4 in Embodiments 1 and 2, the drum member 4*a* and the first and second flanges 51 and 52 are constituted as separate members but the present invention may also be not limited to this constitution. That is, the drum member 4*a* and the first and second flanges 51 and 52 may also be integrally constituted.

According to the above-described embodiments, by a simple assembling method, it is possible to supply the lubricant in an amount necessary for the portions-to-be-supported of the image bearing member, and it is possible to suppress the adherence of the lubricant at a place other than the portions-to-be-supported.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 126016/2012 and 095691/2013 filed Jun. 1, 2012 and Apr. 30, 2013, respectively, which are hereby incorporated by reference.

What is claimed is:

1. An image bearing member unit for use with an image forming apparatus, comprising:

an image bearing member including a supported portion onto which a lubricant is applied;

a supporting member for rotatably supporting said supported portion of said image bearing member;

a frame for holding said supporting member; and a spacing maintaining portion provided on said frame or said image bearing member, wherein said spacing maintaining portion is disposed outside said supported portion with respect to a radial direction of said image bearing member, and is disposed inside, with respect to a longitudinal direction of said image bearing member, a region where said supporting member supports said supported portion, wherein in a state in which said supporting member is not mounted on said frame, said spacing maintaining portion maintains a spacing between said frame and said supported portion in contact with said image bearing member or said frame, and wherein in a state in which said supporting member is mounted on said frame, said supporting member is inserted into the spacing between said frame and said supported portion from outside of said spacing maintaining portion with respect to the longitudinal direction of said image bearing member.

2. A unit according to claim 1, wherein said frame includes an engaging portion for engaging with said supporting member, and wherein in a state in which said supporting member is not mounted on said frame, said spacing maintaining portion maintains a spacing between said engaging portion and the said supported portion.

3. A unit according to claim 2, wherein said engaging portion is provided outside said supported portion with respect to the radial direction and is extended toward an outside of said spacing maintaining portion with respect to the longitudinal direction of said image bearing member, and wherein said supporting member includes a recessed portion to be engaged with said engaging portion.

4. A unit according to claim 1, wherein said frame includes a curved surface portion which is provided outside said supported portion with respect to the radial direction and which is opposed to and curved along an outer peripheral surface of said supported portion, and wherein said spacing maintaining portion maintains, in a state in which said supporting member is not mounted on said frame, a spacing between said curved surface portion and said supported portion.

5. A unit according to claim 4, wherein said frame includes an engaging portion for engaging with said supporting member, and wherein said curved surface portion is provided at said engaging portion.

6. A unit according to claim 1, wherein said spacing maintaining portion is curved along an outer peripheral surface of said supported portion.

7. A unit according to claim 1, wherein said spacing maintaining portion is provided on said frame and maintains, in a state in which said supporting member is not mounted on said frame, the spacing between said frame and said supported portion in contact with said supported portion.

8. A unit according to claim 1, wherein said spacing maintaining portion is provided on said supported portion of said image bearing member and maintains, in a state in which said supporting member is not mounted on said frame, the spacing between said frame and said supported portion in contact with said frame.

9. A unit according to claim 1, wherein said supporting member, said supported portion of said image bearing member, and said spacing maintaining portion are provided in each of an end side and another end side of said image bearing member unit with respect to the longitudinal direction of said image bearing member.

10. A unit according to claim 1, which is detachably mountable to a main assembly of the image forming apparatus.

11. A unit according to claim 1, wherein said spacing maintaining portion is changed, by mounting said supporting member on said frame, from a state in which said spacing maintaining portion is in contact with said image bearing member or said frame to a state in which said spacing maintaining portion is spaced from said image bearing member or said frame.

12. A unit according to claim 1, wherein the lubricant is applied onto said supported portion in an outside of said spacing maintaining portion with respect to the longitudinal direction of said image bearing member but is not applied onto said image bearing member in an inside of said spacing maintaining portion with respect to the longitudinal direction of said image bearing member.

13. An image bearing member unit for use with an image forming apparatus, comprising:

an image bearing member including a supported portion onto which a lubricant is applied;

a supporting member for rotatably supporting said supported portion of said image bearing member;

a frame for holding said supporting member; and a spacing maintaining portion provided on said frame or said image bearing member, wherein in a state in which said supporting member is not mounted on said frame, said spacing maintaining portion maintains a spacing between said frame and said supported portion in contact with said image bearing member or said frame, wherein in a state in which said supporting member is mounted on said frame, said spacing maintaining portion is spaced from said image bearing member or said frame, and wherein in the state in which said supporting member is mounted on said frame, said supporting member is inserted into the spacing between said frame and said supported portion from an outside of said spacing maintaining portion with respect to the longitudinal direction of said image bearing member.

14. A unit according to claim 13, wherein said frame includes an engaging portion for engaging with said supporting member, and wherein in a state in which said supporting member is not mounted on said frame, said spacing maintaining portion maintains a spacing between said engaging portion and said supported portion.

15. A unit according to claim 13, wherein said spacing maintaining portion is provided on said frame and maintains, in a state in which said supporting member is not mounted on said frame, the spacing between said frame and said supported portion in contact with said supported portion.

16. A unit according to claim 13, wherein said spacing maintaining portion is provided on said supported portion of said image bearing member and maintains, in a state in which said supporting member is not mounted on said frame, the spacing between said frame and said supported portion in contact with said frame.

17. A unit according to claim 13, wherein said supporting member, said supported portion of said image bearing member, and said spacing maintaining portion are provided in each of an end side and another end side of said image bearing member unit with respect to the longitudinal direction of said image bearing member.

18. A unit according to claim 13, wherein the lubricant is applied onto said supported portion outside of said spacing maintaining portion with respect to the longitudinal direction of said image bearing member but is not applied onto said image bearing member inside of said spacing maintaining portion with respect to the longitudinal direction of said image bearing member.

19. An image forming apparatus for forming an image on a recording material, comprising:

an image bearing member unit, wherein said image bearing member unit comprises:

an image bearing member including a supported portion onto which a lubricant is applied;

a supporting member for rotatably supporting said supported portion of said image bearing member;

a frame for holding said supporting member; and a spacing maintaining portion provided on said frame or said image bearing member, wherein said spacing maintaining portion is disposed outside said supported portion with respect to a radial direction of said image bearing member, and is disposed inside, with respect to a longitudinal direction of said image bearing member, a region where said supporting member supports said supported portion, wherein in a state in which said supporting member is not mounted on said frame, said spacing maintaining portion maintains a spacing between said frame and said supported portion in contact with said image bearing member or said frame, and wherein in a state in which said supporting member is mounted on said frame, said supporting member is inserted, into the spacing between said frame and said supported portion, from an outside of said spacing maintaining portion with respect to the longitudinal direction of said image bearing member.

20. An apparatus according to claim 19, wherein said frame includes an engaging portion for engaging with said supporting member, and wherein in a state in which said supporting member is not mounted on said frame, said spacing maintaining portion maintains a spacing between said engaging portion and said supported portion.

21. A unit according to claim 7, wherein said spacing maintaining portion is integrally formed with said frame.

22. A unit according to claim 1, wherein said spacing maintaining portion includes a surface configured to prevent the lubricant from moving to a position inside said spacing maintaining portion with respect to the longitudinal direction.

* * * * *